US012262741B2

(12) United States Patent
Kim et al.

(10) Patent No.: US 12,262,741 B2
(45) Date of Patent: Apr. 1, 2025

(54) AEROSOL GENERATING DEVICE

(71) Applicant: KT&G CORPORATION, Daejeon (KR)

(72) Inventors: Min Kyu Kim, Seoul (KR); Won Kyeong Lee, Gyeonggi-do (KR); Jong Sub Lee, Gyeonggi-do (KR); Byung Sung Cho, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 556 days.

(21) Appl. No.: 17/610,786

(22) PCT Filed: Jun. 10, 2021

(86) PCT No.: PCT/KR2021/007276
§ 371 (c)(1),
(2) Date: Nov. 12, 2021

(87) PCT Pub. No.: WO2021/261815
PCT Pub. Date: Dec. 30, 2021

(65) Prior Publication Data

US 2022/0369703 A1 Nov. 24, 2022

(30) Foreign Application Priority Data

Jun. 24, 2020 (KR) ..... 10-2020-0077378

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01);
(Continued)

(58) Field of Classification Search
None
See application file for complete search history.

(56) References Cited

U.S. PATENT DOCUMENTS 9,498,002 B1 * 11/2016 Soreide ..... A24F 40/30
10,405,580 B2 9/2019 Karles
(Continued)

FOREIGN PATENT DOCUMENTS

CN 105446381 A 3/2016
CN 109310835 A 2/2019
(Continued)

OTHER PUBLICATIONS

International Search Report of PCT/KR2021/007276 dated Sep. 15, 2021 [PCT/ISA/210].
(Continued)

*Primary Examiner* — Michael H. Wilson
*Assistant Examiner* — Michael T Fulton
(74) *Attorney, Agent, or Firm* — Sughrue Mion, PLLC

(57) ABSTRACT

An aerosol generating device includes a first cartridge including a first material and a delivery hole, a second cartridge including chambers for accommodating a second material through which an aerosol passes, a position of the second cartridge with respect to the first cartridge being changeable, a remaining amount sensor configured to detect a remaining amount of the first material, and a controller configured to determine a consumption amount at which the first material is consumed with respect to a usage chamber that currently passes the aerosol based on the detected remaining amount of the first material and to compare the consumption amount of the first material with a pre-set reference consumption amount of the first material with
(Continued)

respect to the usage chamber, thereby determining a position changing time at which changing of a position of the second cartridge is required.

13 Claims, 11 Drawing Sheets

(51) Int. Cl.

| | |
|---|---|
| ***A24F 40/20*** | (2020.01) |
| ***A24F 40/42*** | (2020.01) |
| ***A24F 40/485*** | (2020.01) |
| ***A24F 40/51*** | (2020.01) |
| ***A24F 40/60*** | (2020.01) |

(52) U.S. Cl.
CPC ..... *A24F 40/485* (2020.01); *A24F 40/51* (2020.01); *A24F 40/60* (2020.01)

(56) References Cited

U.S. PATENT DOCUMENTS

| | | | | |
|---|---|---|---|---|
| 10,952,473 | B2 | 3/2021 | Bessant et al. | |
| 2013/0228191 | A1 | 9/2013 | Newton | |
| 2016/0044965 | A1 | 2/2016 | Liu | |
| 2016/0337362 | A1* | 11/2016 | Cameron | G06Q 20/3278 |
| 2018/0007965 | A1 | 1/2018 | Karles | |
| 2018/0177238 | A1 | 6/2018 | Bessant et al. | |
| 2018/0310629 | A1 | 11/2018 | Qiu | |
| 2018/0369519 | A1* | 12/2018 | Adelson | A61M 11/042 |
| 2019/0328044 | A1 | 10/2019 | Qiu | |
| 2019/0335817 | A1 | 11/2019 | Freeman et al. | |
| 2021/0244098 | A1 | 8/2021 | Watson et al. | |
| 2021/0251295 | A1 | 8/2021 | Mironov et al. | |

FOREIGN PATENT DOCUMENTS

| | | | |
|---|---|---|---|
| CN | 110022705 | A | 7/2019 |
| CN | 110507004 | A | 11/2019 |
| EP | 3 545 780 | A1 | 10/2019 |
| KR | 10-2018-0111806 | A | 10/2018 |
| KR | 10-2019-0042014 | A | 4/2019 |
| WO | 2015/052192 | A1 | 4/2015 |
| WO | 2018/114849 | A1 | 6/2018 |

OTHER PUBLICATIONS

Written Opinion of PCT/KR2021/007276 dated Sep. 15, 2021 [PCT/ISA/237].
Office Action dated May 9, 2022 issued by the Korean Patent Office in Korean Application No. 10-2020-0077378.
Extended European Search Report dated May 10, 2022 in European Application No. 21805335.3.
Office Action dated Mar. 28, 2023 from the Chinese Patent Firm in Application No. 202180004463.3.

* cited by examiner

[Fig. 1]
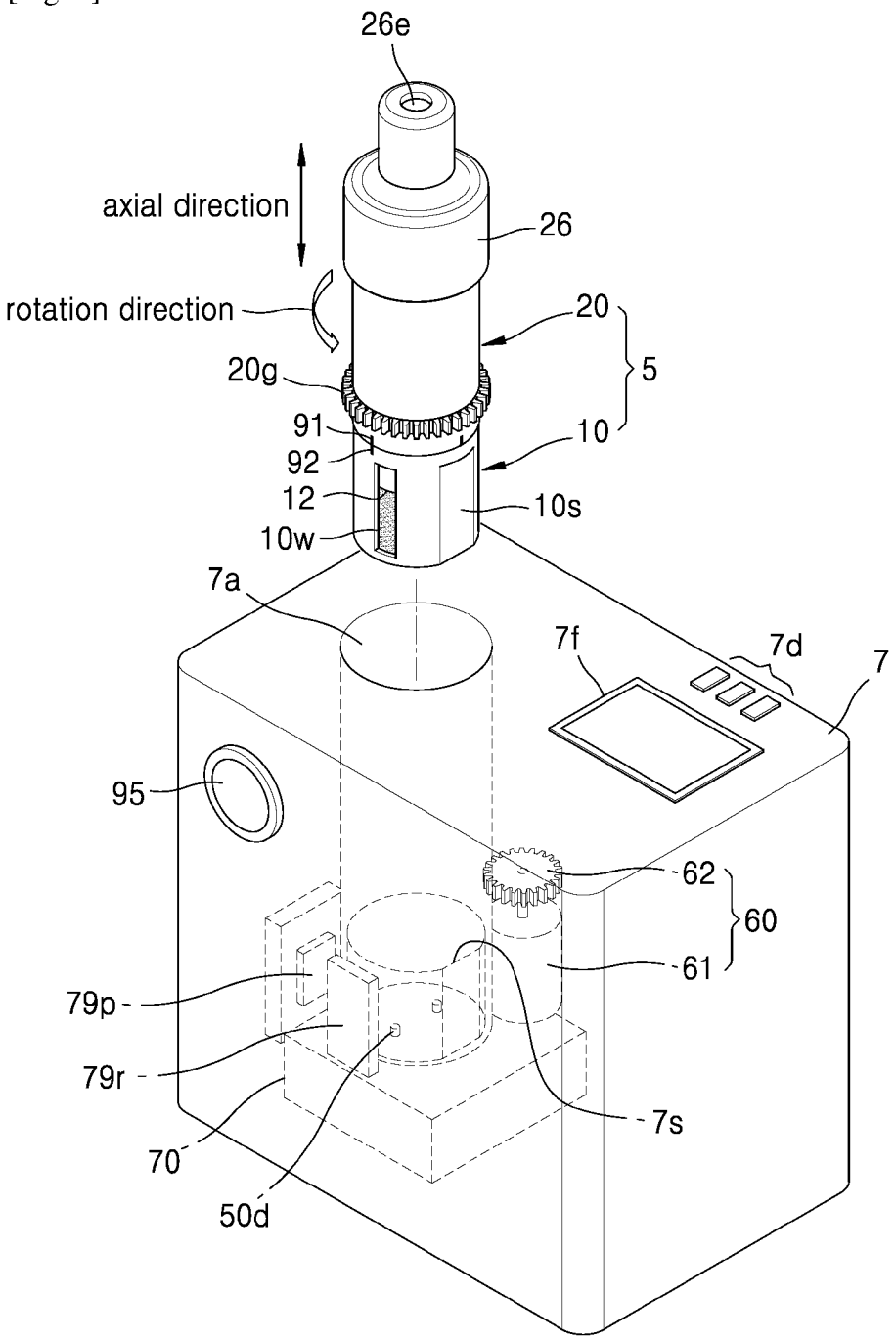

[Fig. 2]
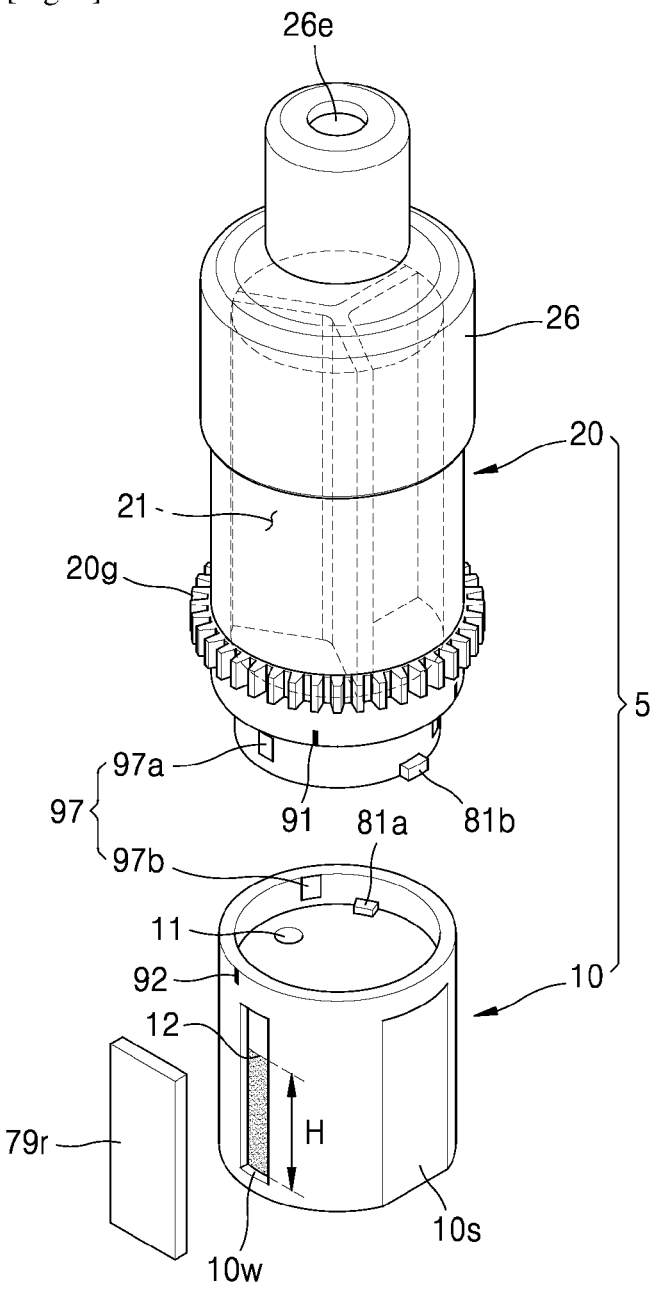

[Fig. 3]
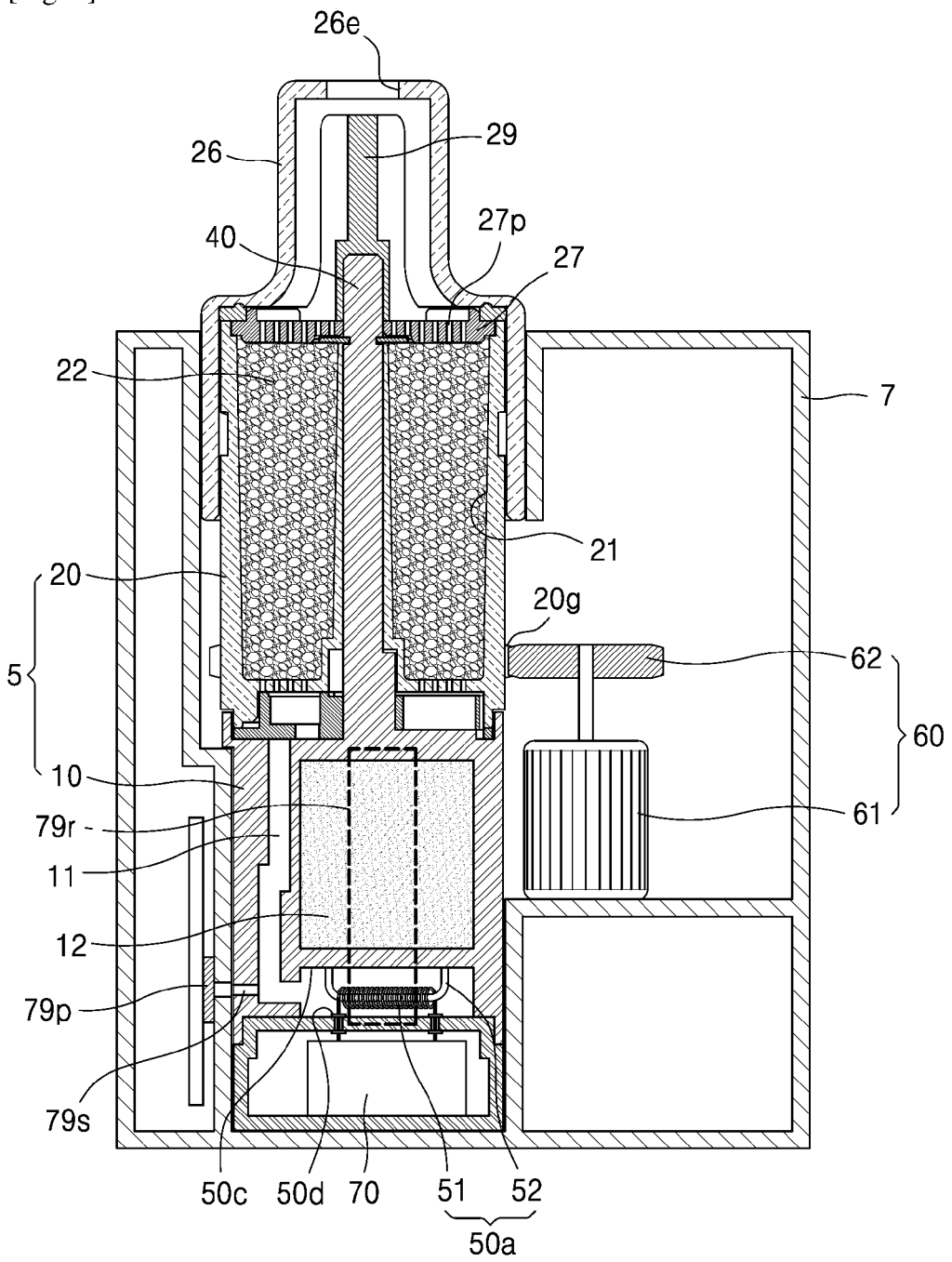

[Fig. 4]
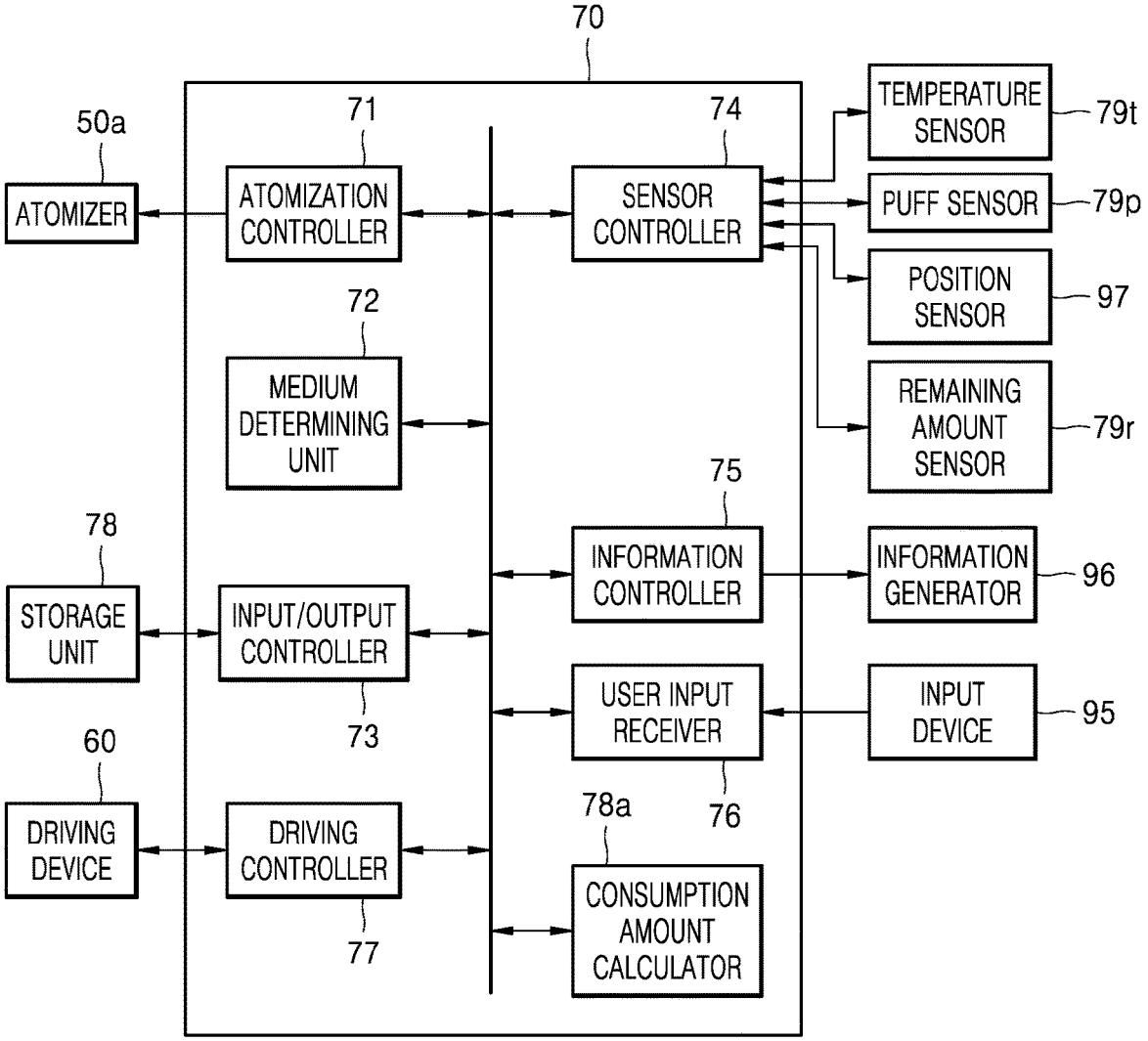
[Fig. 5]
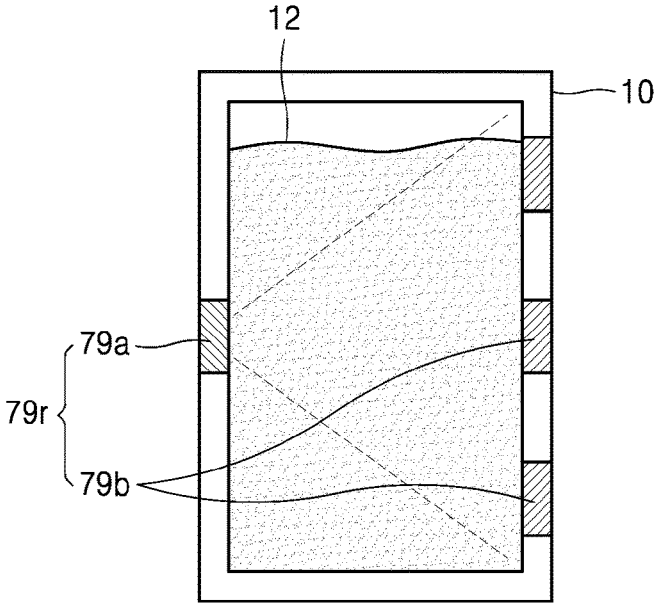

[Fig. 6]
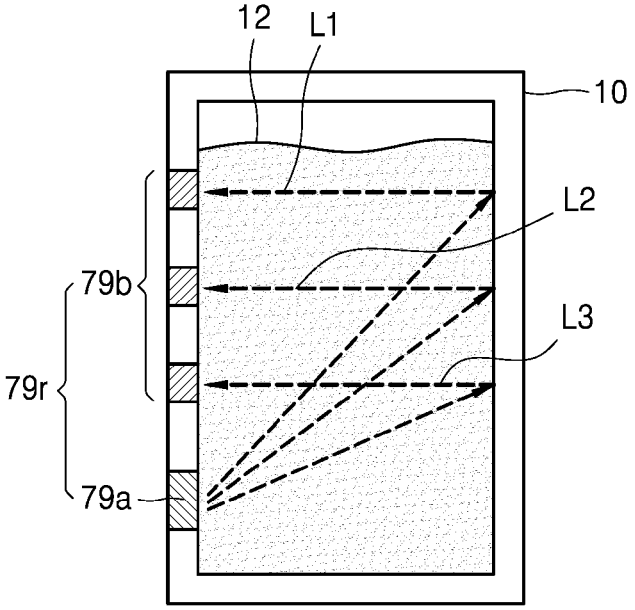
[Fig. 7]
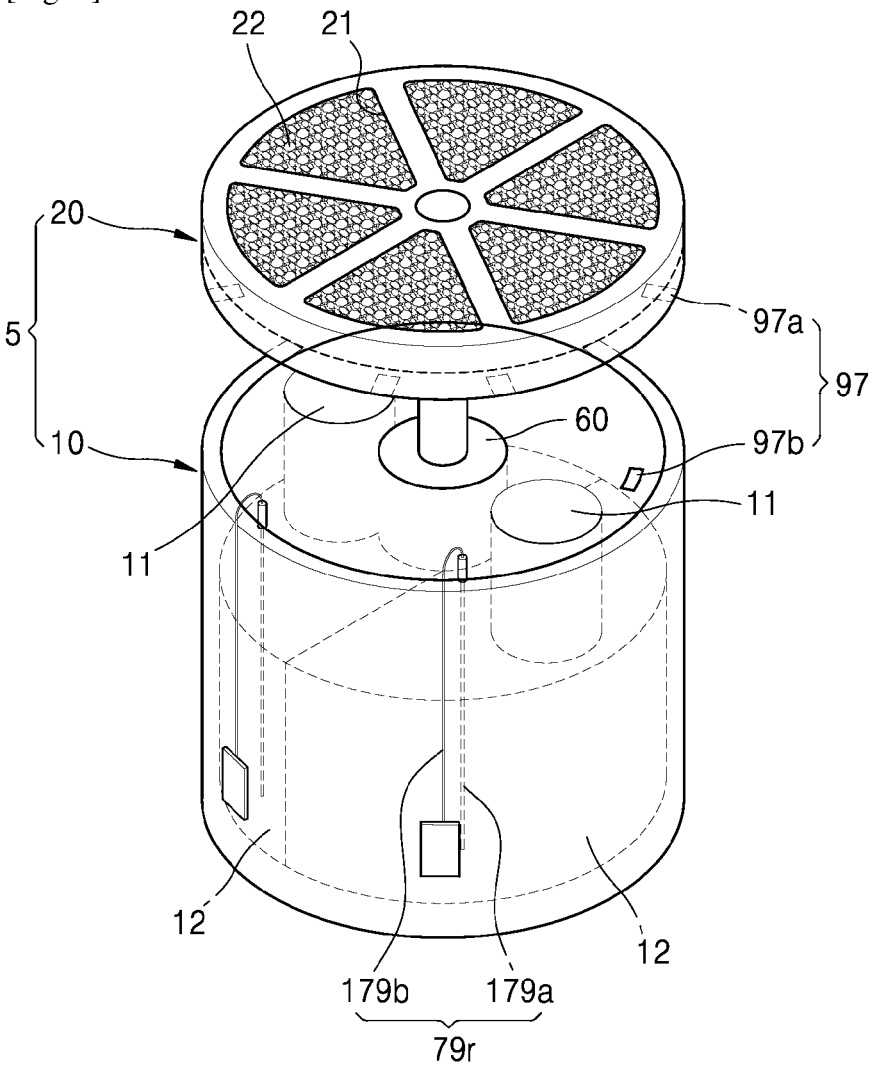

[Fig. 8]
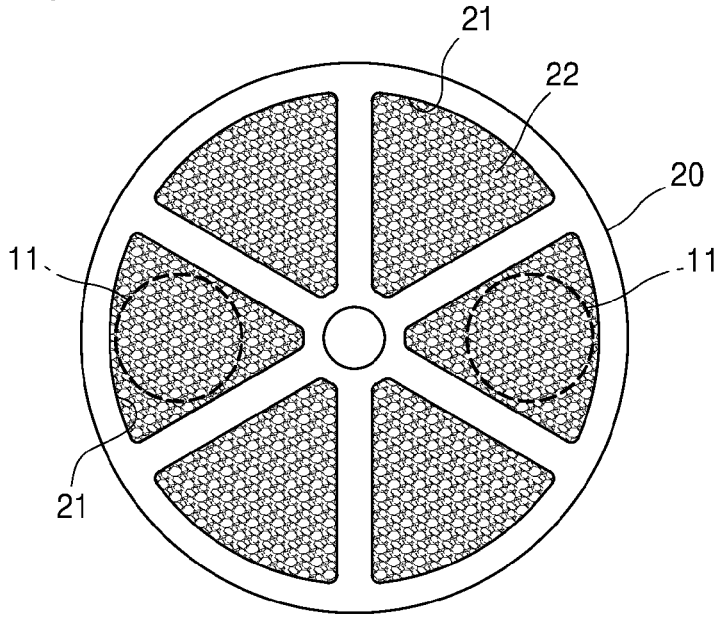
[Fig. 9]
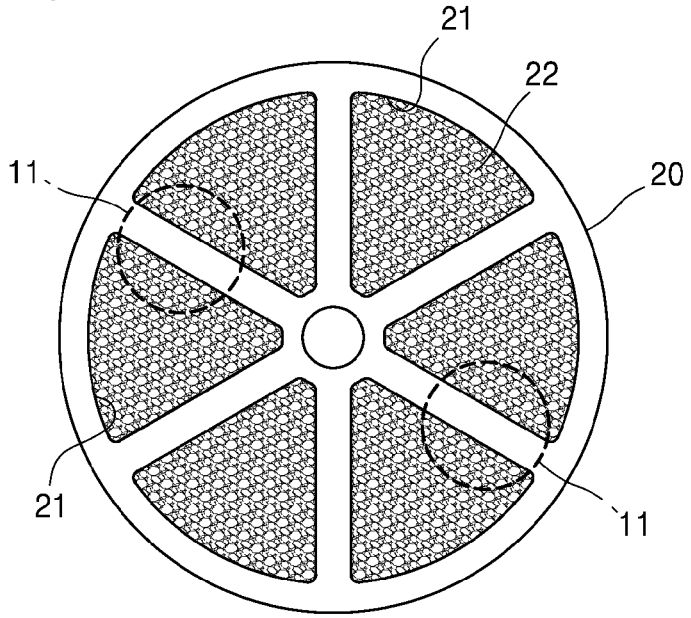

[Fig. 10]
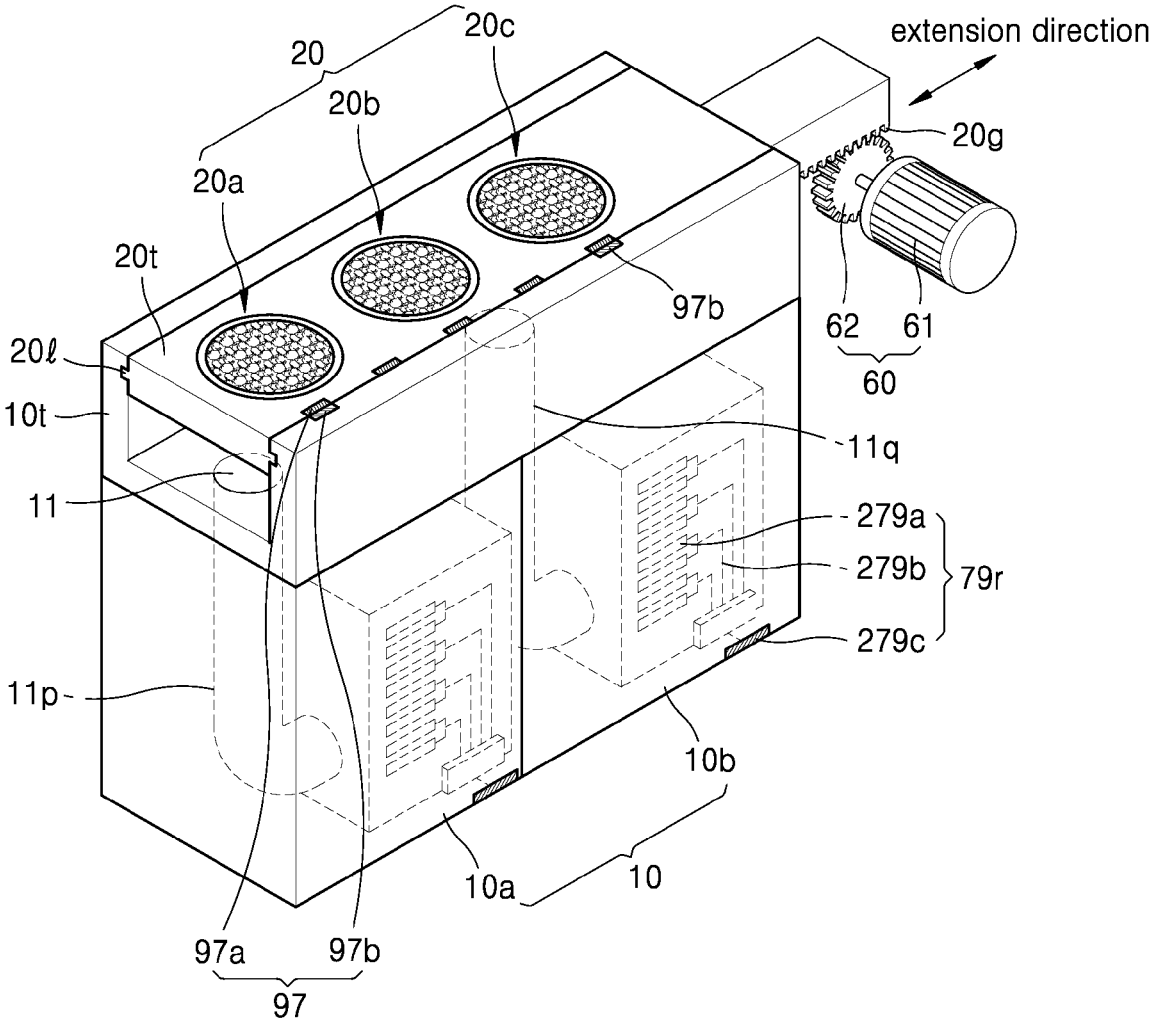

[Fig. 11]
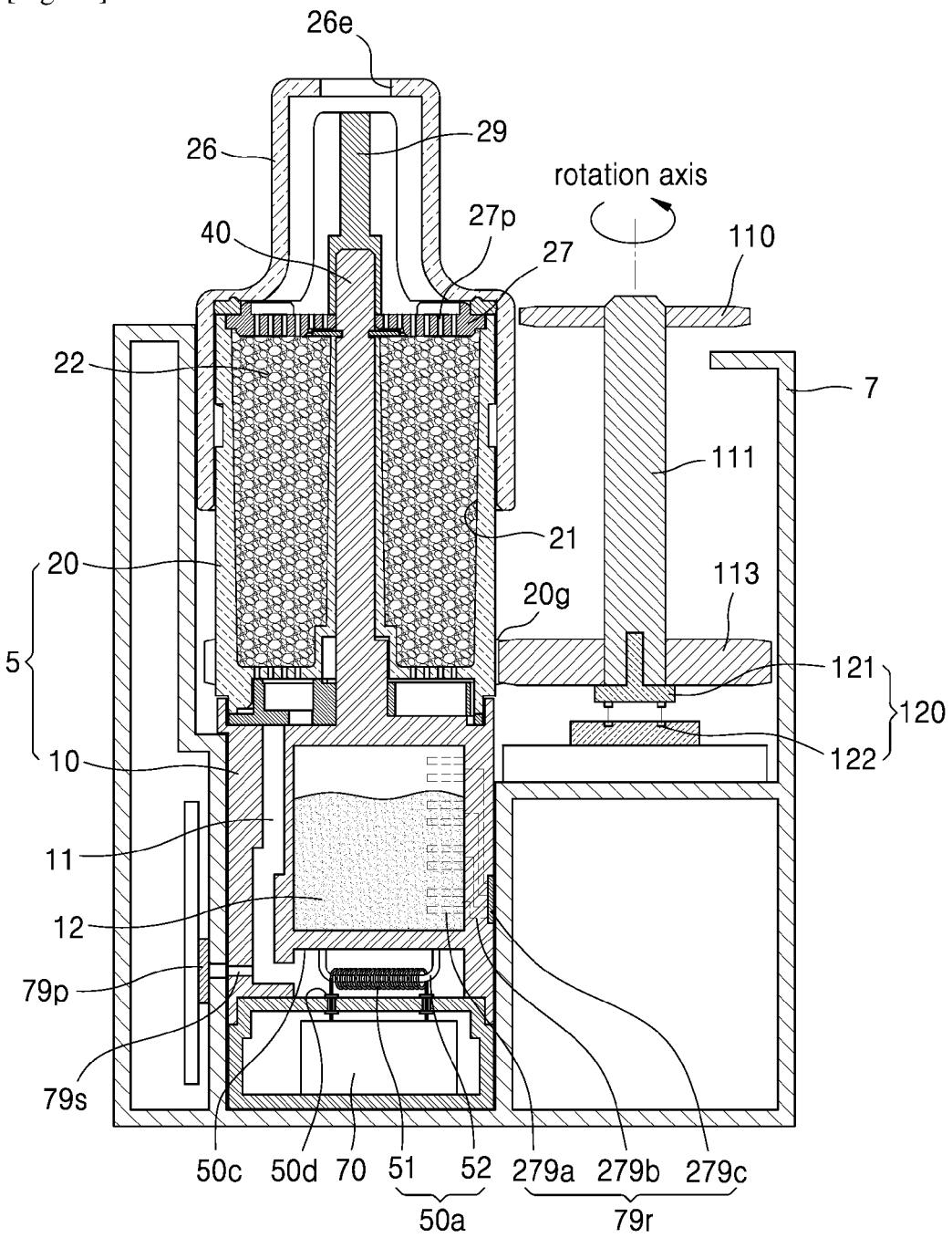

[Fig. 12]
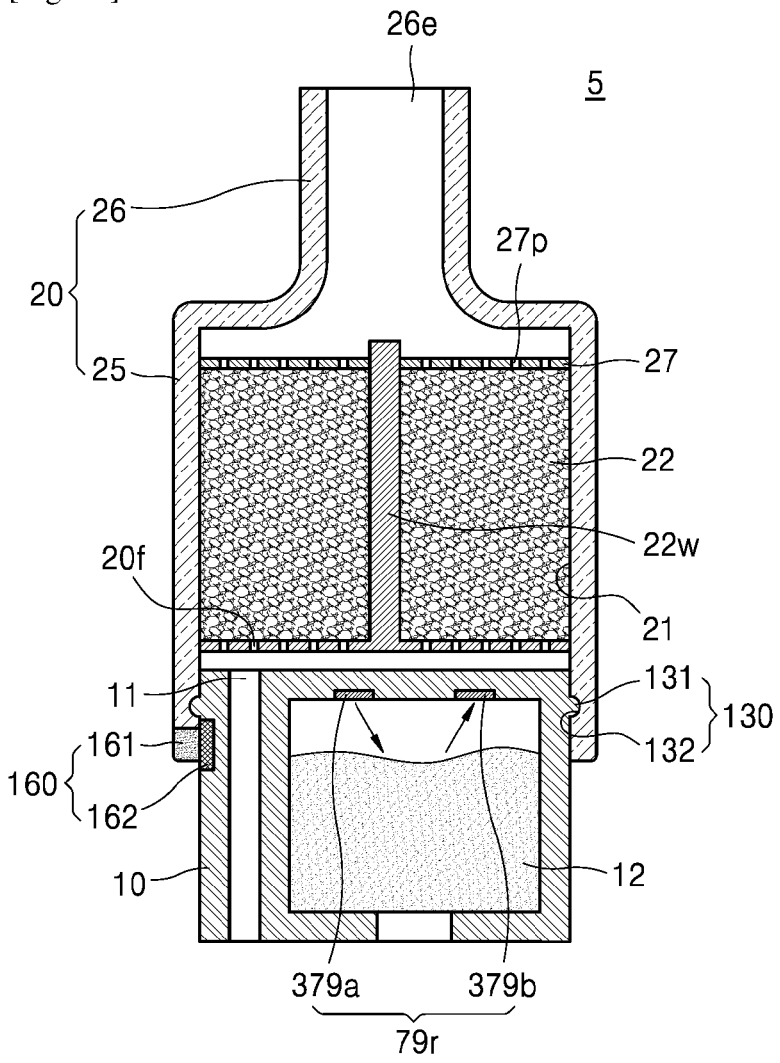

[Fig. 13]
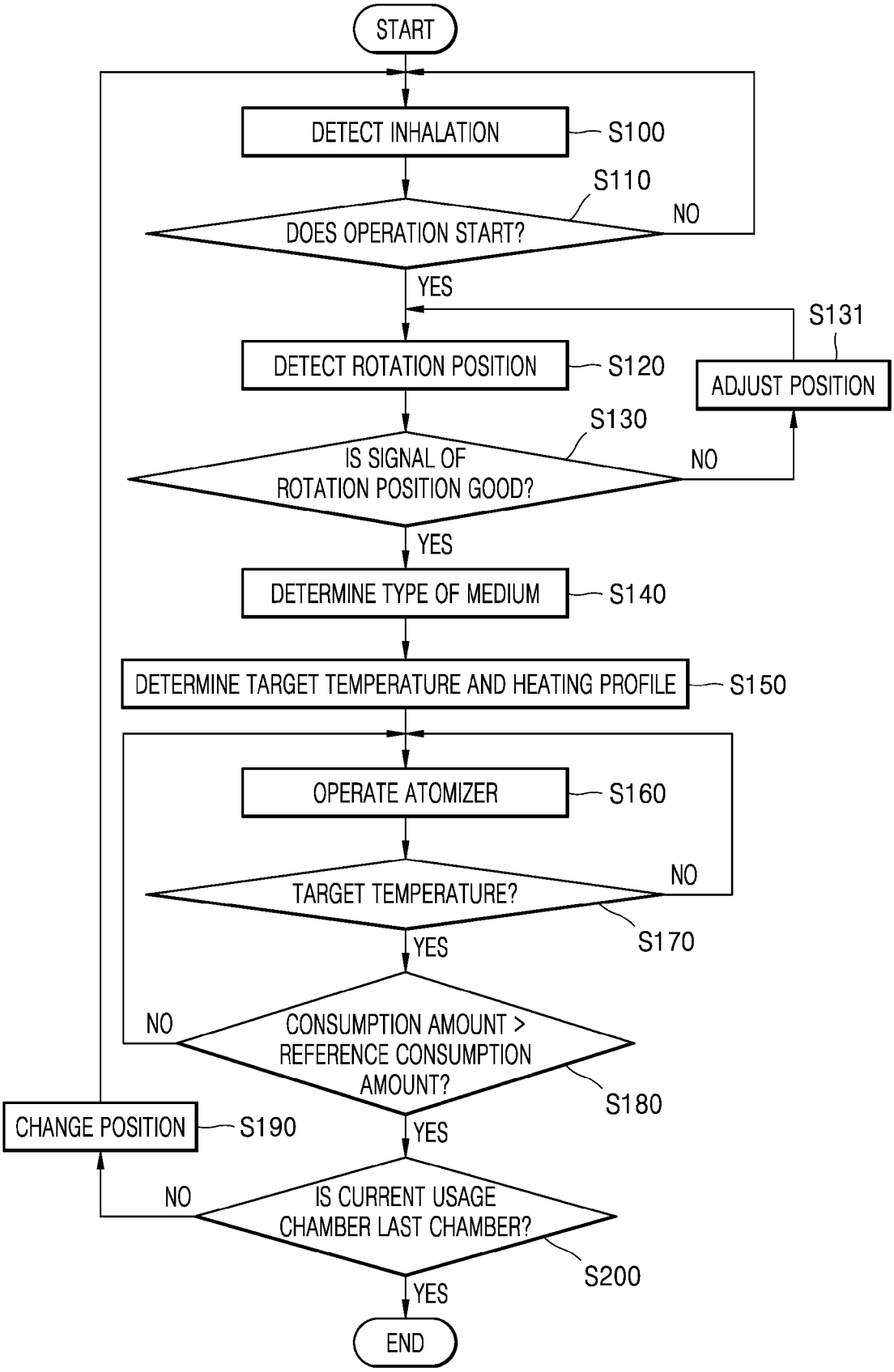

[Fig. 14]
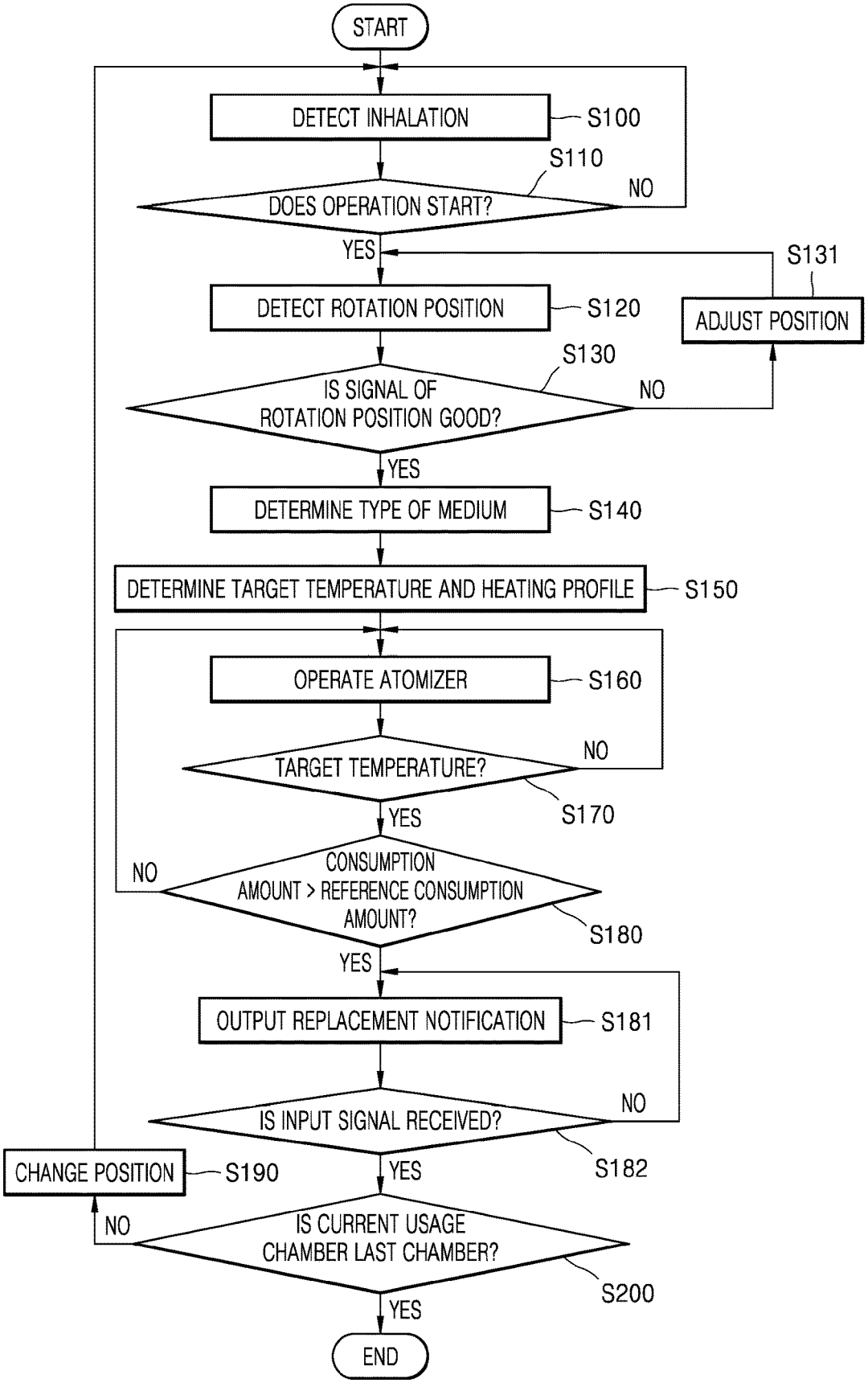

AEROSOL GENERATING DEVICE

CROSS REFERENCE TO RELATED APPLICATIONS

This application is a National Stage of International Application No. PCT/KR2021/007276 filed on Jun. 10, 2021, claiming priority based on Korean Patent Application No. 10-2020-0077378 filed on Jun. 24, 2020.

TECHNICAL FIELD

One or more embodiments of the present disclosure relate to an aerosol generating device, and more particularly, to an aerosol generating device configured to adjust the position of a second cartridge based on the remaining amount of a first cartridge.

BACKGROUND ART

Recently, there is an increasing demand for an aerosol generating device that generates aerosol based on a non-combustion method without combustion of tobacco. For example, an aerosol generating device may deliver aerosol to the distal airway of a user by generating aerosol with a non-combustion method or by generating aerosol from aerosol generating material and having the aerosol pass through a flavor medium before outputting from the aerosol generating device.

DISCLOSURE OF INVENTION

Technical Problem

One or more embodiments include an aerosol generating device that may be easy to use and carry. One or more embodiments also include an aerosol generating device that generates an aerosol of good quality capable of satisfying various needs of consumers.

Solution to Problem

One or more embodiments of the present disclosure provide an aerosol generating device that may solve various problems of the related art.

Technical goals to be achieved by embodiments of the present disclosure are not limited to the above-described goals, and goals that are not mentioned will be clearly understood by one of ordinary skill in the art from the present specification and the accompanying drawings.

An aerosol generating device according to an embodiment may include a first cartridge configured to accommodate a first material therein and including a delivery hole through which an aerosol generated from the first material is delivered, a second cartridge including a plurality of chambers for accommodating a second material through which the aerosol delivered from the first cartridge passes and is discharged to an outside of the aerosol generating device, a position of the second cartridge with respect to the first cartridge being changeable so that at least one of the plurality of chambers corresponds to the delivery hole, a remaining amount sensor configured to detect a remaining amount of the first material so as to generate a sensing signal, and a controller configured to determine, based on the sensing signal, a consumption amount at which the first material is consumed with respect to a usage chamber that currently passes the aerosol among the plurality of chambers, and compare the consumption amount of the first material with a pre-set reference consumption amount of the first material with respect to the usage chamber, and determine a position changing time at which changing of a position of the second cartridge with respect to the first cartridge is required.

Advantageous Effects of Invention

An aerosol generating device according to the above-described embodiment may be easily carried and used because a first cartridge accommodating a first material and a second cartridge accommodating a second material may be handled as one integrated device.

In addition, because chambers of the second cartridge include different types of second materials, the user may select a desired second material by selecting one from among the chambers so that the user may freely enjoy an aerosol having various flavors.

In addition, because a consumption amount at which the first material of the first cartridge is consumed with respect to a usage chamber currently in use, is determined based on a signal of a remaining amount sensor and the relative position of the second cartridge with respect to the first cartridge may be changed based on the result of comparing the consumption amount with a pre-set reference consumption amount, convenient use and stable control of the aerosol generating device is possible.

In addition, even when the first cartridge is designed to accommodate a large amount of first material, chambers in use to supply the aerosol may be selected by automatically changing relative positions of the first cartridge and the second cartridge by using a driving device, so that the effect of replacing a new second material may be obtained without replacing the second cartridge including the second material.

In addition, because the relative positions of the first cartridge and the second cartridge are adjusted to select chambers in use to supply the aerosol, the effect of replacing a new medium may be obtained without replacing a cartridge for a medium.

BRIEF DESCRIPTION OF DRAWINGS

FIG. 1 is a perspective view of an aerosol generating device according to an embodiment;

FIG. 2 is a perspective view illustrating a separated state of some components of the aerosol generating device shown in FIG. 1;

FIG. 3 is a longitudinal cross-sectional view of the aerosol generating device of FIG. 1;

FIG. 4 is a block diagram schematically illustrating a connection relationship between some embodiments of the aerosol generating device shown in FIG. 1;

FIG. 5 is a cross-sectional view schematically illustrating some embodiments of an aerosol generating device according to another embodiment;

FIG. 6 is a cross-sectional view schematically illustrating some embodiments of an aerosol generating device according to another embodiment;

FIG. 7 is a perspective view schematically illustrating some embodiments of an aerosol generating device according to another embodiment;

FIG. 8 is a latitudinal cross-sectional view illustrating one operating state of the aerosol generating device shown in FIG. 7;

FIG. 9 is a latitudinal cross-sectional view illustrating another operating state of the aerosol generating device shown in FIG. 7;

FIG. 10 is a perspective view schematically illustrating some components of an aerosol generating device according to another embodiment;

FIG. 11 is a longitudinal cross-sectional view schematically illustrating an aerosol generating device according to another embodiment;

FIG. 12 is a longitudinal cross-sectional view schematically illustrating a coupling relationship between some components of an aerosol generating device according to another embodiment;

FIG. 13 is a flowchart schematically illustrating a method of generating an aerosol by using the aerosol generating device according to embodiments shown in FIGS. 1 through 12, according to an embodiment; and FIG. 14 is a flowchart schematically illustrating a method of generating an aerosol by using the aerosol generating device according to embodiments shown in FIGS. 1 through 12, according to another embodiment.

BEST MODE FOR CARRYING OUT THE INVENTION

An aerosol generating device according to an embodiment includes a first cartridge configured to accommodate a first material therein and including a delivery hole through which an aerosol generated from the first material is delivered, a second cartridge including a plurality of chambers for accommodating a second material through which the aerosol delivered from the first cartridge passes and is discharged to an outside of the aerosol generating device, a position of the second cartridge with respect to the first cartridge being changeable so that at least one of the plurality of chambers corresponds to the delivery hole, a remaining amount sensor configured to detect a remaining amount of the first material so as to generate a sensing signal, and a controller configured to determine, based on the sensing signal, a consumption amount at which the first material is consumed with respect to a usage chamber that currently passes the aerosol among the plurality of chambers, compare the consumption amount of the first material with a pre-set reference consumption amount of the first material with respect to the usage chamber, and determine a position changing time at which changing of a position of the second cartridge with respect to the first cartridge is required.

The aerosol generating device may further include a driving device configured to change the position of the second cartridge with respect to the first cartridge by moving at least one of the first cartridge and the second cartridge, wherein the controller changes the position of the second cartridge with respect to the first cartridge by operating the driving device at the position changing time.

The aerosol generating device may further include an information generator configured to transmit information to the outside of the aerosol generating device, wherein the controller outputs a replacement notification for changing positions of the plurality of chambers to the information generator at the position changing time.

The aerosol generating device may further include an input device configured to receive a user's input manipulation to generate an input signal and a driving device configured to change the position of the second cartridge with respect to the first cartridge by moving at least one of the first cartridge and the second cartridge, wherein the controller changes the position of the second cartridge with respect to the first cartridge by operating the driving device based on the input signal of the input device.

The aerosol generating device may further include a handle that is manipulable by a user to change the position of the second cartridge with respect to the first cartridge and a force transmission portion configured to transmit force of the user from the handle to the first cartridge or the second cartridge to change the position of the second cartridge with respect to the first cartridge.

Any one of the first cartridge and the second cartridge may be rotatably coupled to the other one of the first cartridge and the second cartridge, and the driving device may rotate any one of the first cartridge and the second cartridge.

Any one of the first cartridge and the second cartridge may be coupled to another one of the first cartridge and the second cartridge to be movable linearly, and the driving device may linearly move any one of the first cartridge and the second cartridge.

The controller may change the position of the second cartridge with respect to the first cartridge so that a position of any one of the plurality of chambers is aligned with the delivery hole.

The controller may change the position of the second cartridge with respect to the first cartridge so that adjacent chambers among the plurality of chambers simultaneously overlap the delivery hole.

The remaining amount sensor may include any one or any combination of a capacitive sensor, an ultrasonic wave sensor, and an optical sensor.

The first cartridge may include a plurality of storages for accommodating the first material therein, each of the plurality of storages may include the delivery hole, and the position of the second cartridge with respect to the first cartridge may be changed so that a position of at least one of the plurality of chambers corresponds to the delivery hole of any one of the plurality of storages.

MODE FOR THE INVENTION

With respect to the terms used to describe the various embodiments of the present disclosure, general terms which are currently and widely used are selected in consideration of functions of structural elements in the various embodiments of the present disclosure. However, the meaning of the terms can be provided according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meaning of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

If one component or layer is mentioned to be "over," "above," "connected to," or "combined with" another component or layer, the one component or layer is arranged to be over, above, connected to, or combined with the other component or layer with or without an intervening component(s) or layer(s). In contrast, if one component or layer is mentioned to be "directly over," "directly above," "directly connected to," or "directly combined with" another component or layer, there is no additional components or layers between the components or layers. In the disclosure, the same reference numbers may indicate the same components.

Hereinafter, embodiments of the present disclosure will be described more fully with reference to the accompanying drawings, in which non-limiting example embodiments of the present disclosure are shown such that one of ordinary skill in the art may easily work the present disclosure. Embodiments of the present disclosure may, however, be embodied in many different forms and should not be construed as being limited to the example embodiments set forth herein.

FIG. 1 is a perspective view of an aerosol generating device according to an embodiment, FIG. 2 is a perspective view illustrating a separated state of some components of the aerosol generating device shown in FIG. 1, and FIG. 3 is a longitudinal cross-sectional view of the aerosol generating device of FIG. 1.

The aerosol generating device according to the embodiment shown in FIGS. 1 through 3 may supply an aerosol to a user by heating an aerosol generating material in a method of using electricity, an induction magnetic field, or an ultrasonic wave, and thereby generating the aerosol.

Referring to FIG. 3, the aerosol generating device may include a first cartridge 10 in which a first material 12 is accommodated and which includes a delivery hole 11 through which the aerosol generated from the first material is delivered, and a second cartridge 20 including a plurality of chambers 21 for accommodating a second material 22 through which the aerosol delivered from the first cartridge 10 passes and is discharged to the outside of the aerosol generating device.

The first cartridge 10 and the second cartridge 20 may be integrally coupled to each other and may form an aerosol generating assembly 5 so as to be handled as one integrated component.

Referring to FIG. 1, the aerosol generating device may include a case 7 including an accommodation passage 7*a* for accommodating the aerosol generating assembly 5. The case 7 may include a display device 7*f* for transmitting information to the user on an outer surface, and a display lamp 7*d* for transmitting a notification regarding an operating state of the aerosol generating device to the user. The display device 7*f* and the display lamp 7*d* may be examples of information generators for notifying various types of notifications to the user, and the information generator may be implemented as a speaker or a vibration generator.

Also, the case 7 may include an input device 95 that may be manipulated by the user and detects the user's manipulation to generate a user input signal.

In the embodiment shown in FIGS. 1 through 3, the case 7 may have an approximately rectangular shape, and the aerosol generating assembly 5 may have a cylindrical shape that extends long in an axial direction. However, embodiments are not limited by the shapes of the case 7 and the aerosol generating assembly 5. For example, the case 7 may be transformed into several forms such as a cylindrical shape extending long in the axial direction of the aerosol generating assembly 5, a cylindrical shape with an elliptical cross-section, a flat cylindrical shape, a regular hexahedron shape, and a rectangular parallelepiped shape. Also, the aerosol generating assembly 5 may be implemented to have a rectangular parallelepiped shape, a regular hexahedron shape, and the like.

The first cartridge 10 and the second cartridge 20 may be coupled to each other so that the relative positions of the first cartridge 10 and the second cartridge 20 with respect to each other may be changed. In the embodiment shown in FIGS. 1 through 3, the second cartridge 20 may be rotated relative to the first cartridge 10 so that the relative positions of the first cartridge 10 and the second cartridge 20 may be changed. The first cartridge 10 may have a cylindrical shape as a whole and include a position fixing surface 10*s* which is at least partially formed differently from the extension direction of the cylindrical surface.

The accommodation passage 7*a* of the case 7 may provide a hollow cylindrical passage that extends long so as to accommodate the aerosol generating assembly 5. At least a portion of the accommodation passage 7*a* may have a position maintenance surface 7*s* formed differently from the extension direction of the cylindrical surface of an inner wall surface of the accommodation passage 7*a* so as to have a shape corresponding to the position fixing surface 10*s* of the first cartridge 10.

When the aerosol generating assembly 5 is inserted into the accommodation passage 7*a* of the case 7, the position maintenance surface 7*s* comes into contact with the position fixing surface 10*s* so that the position of the first cartridge 10 may be stably maintained with respect to the case 7. That is, while the second cartridge 20 is rotated with respect to the first cartridge 10, the position fixing surface 10*s* of the first cartridge 10 may be supported by the position maintenance surface 7*s* so that the first cartridge 10 may not be rotated and may be stably maintained while being fixed to the case 7.

Also, the position maintenance surface 7*s* and the position fixing surface 10*s* may perform an alignment function for aligning the relative position of an axial center of the aerosol generating assembly 5 with respect to the axial center of the accommodation passage 7*a* when the aerosol generating assembly 5 is inserted into the accommodation passage 7*a* of the case 7. That is, (the angular position of) the position fixing surface 10*s* of the first cartridge 10 of the aerosol generating assembly 5 and (the angular position of) the position maintenance surface 7*s* of the accommodation passage 7*a* may be required to correspond to each other so that the aerosol generating assembly 5 may be inserted into the accommodation space 7*a* of the case 7.

The case 7 may include an electrical terminal 50*d* that is arranged at one end of the accommodation passage 7*a* and supplies electricity to the first cartridge 10. When the aerosol generating assembly 5 is aligned with the accommodation passage 7*a* so that the position fixing surface 10*s* of the first cartridge 10 of the aerosol generating assembly 5 and the position maintenance surface 7*s* of the accommodation passage 7*a* correspond to each other, the electrical terminal 50*d* may be accurately and electrically connected to the first cartridge 10.

Embodiments of the present disclosure are not limited by the coupling structure of the first cartridge 10 and the second cartridge 20 described above, and the first cartridge 10 and the second cartridge 20 may be rotatably coupled to each other by using various coupling structures. For example, the structure of the aerosol generating assembly 5 shown in FIGS. 1 through 3 may be modified so that the first cartridge 10 may be rotated with respect to the second cartridge 20 in a state in which the position of the second cartridge 20 is fixedly maintained to the case 7. Alternatively, each of the first cartridge 10 and the second cartridge 20 may be rotated so that the relative positions of the first cartridge 10 and the second cartridge 20 may be changed.

The case 7 may include an atomizer 50*a* that generates the aerosol, and the first cartridge 10 may deliver the aerosol that is generated from the atomizer 50*a*, to the second cartridge 20.

The first cartridge 10 may accommodate the first material 12. The first material 12 may be, for example, a liquid or gel material. The first material 12 may be maintained in a liquid state by being impregnated within a porous material such as a sponge or cotton wool inside the first cartridge 10.

The first material 12 may be a liquid material and may include, for example, a tobacco-containing material including volatile tobacco incense ingredients, or a non-tobacco material.

The first material 12 may include, for example, water, a solvent, ethanol, a plant extract, spices, flavorings, or a vitamin mixture.

The spices of the first material 12 may include menthol, peppermint, spearmint oil, and various fruit-flavored ingredients, but are not limited thereto. The flavorings may include ingredients capable of providing various flavors or tastes to the user.

The vitamin mixture of the first material 12 may be a mixture of at least one of vitamin A, vitamin B, vitamin C, and vitamin E, but are not limited thereto.

Also, the first material 12 may include an aerosol forming agent such as glycerin and propylene glycol.

The atomizer 50*a* and a controller 70 that generate an aerosol by heating the first material 12 of the first cartridge 10 may be installed under the accommodation passage 7*a* inside the case 7. The controller 70 may include a battery for supplying power to the atomizer 50*a* and a control chip or control circuit board for controlling the operation of the atomizer 50*a*.

The atomizer 50*a* may include a wick 52 that absorbs from the first cartridge 10 and holds the first material 12, a heater 51 that is wound around the wick 52 and is in contact with or adjacent to the wick 52 to heat the first material 12 and generate an aerosol, and an aerosol generating chamber 50*c* that surrounds the heater 51 and forms an atmosphere for generating an aerosol.

The atomizer 50*a* may generate an aerosol by converting a phase of the aerosol generating material into a gaseous phase. The aerosol may refer to a gas in which vaporized particles generated from an aerosol generating material are mixed with air.

The heater 51 may be an electro-resistive heating body that generates heat by electricity supplied from the controller 70. The atomizer 50*a* may include an electro-resistive heating body. However, embodiments of the present disclosure are not limited by such configuration of the atomizer 50*a*. The atomizer 50*a* may generate an aerosol, for example, in an ultrasonic wave method or in an induction heating method.

The first cartridge 10 may include a delivery hole 11 that extends along the extension direction of the first cartridge 10 to deliver the aerosol. The aerosol generating chamber 50*c* may deliver the aerosol generated by the heater 51 to the delivery hole 11 of the first cartridge 10. Thus, the aerosol supplied from the aerosol generating chamber 50*c* may be delivered to the second cartridge 20 via the delivery hole 11 of the first cartridge 10.

The second cartridge 20 may be disposed to rotate with respect to the first cartridge 10 and include a plurality of chambers 21, which are sequentially positioned along a rotation direction of the second cartridge 20, and a second material 22 which is accommodated in each of the plurality of chambers 21 and through which the aerosol passes.

The second material 22 may be in a solid state and may include, for example, a powder or a granule that is a set of small-sized particles.

The second material 22 may include, for example, a tobacco-containing material including volatile tobacco incense ingredients, or may include additives, such as flavors, a wetting agent, and/or organic acid, or a flavored material such as menthol or a moisturizer, or any one ingredient of a plant extract, spices, flavorings, and a vitamin mixture, or a mixture of these ingredients.

The spices of the second material 22 may include menthol, peppermint, spearmint oil, and various fruit flavored ingredients, but is not limited thereto.

The flavorings of the second material 22 may include ingredients capable of providing various flavors or tastes to the user.

The vitamin mixture of the second material 22 may include a mixture of at least one of vitamin A, vitamin B, vitamin C, and vitamin E, but are not limited thereto.

The second cartridge 20 may include a plurality of chambers 21 that are sequentially apart from each other in the rotation direction of the second cartridge 20. The chambers 21 may be partitioned by a barrier wall to be independent from each other.

In FIG. 2, three chambers 21 are provided. However, embodiments are not limited by the number of chambers 21, and two or four or more chambers 21 may be provided in the second cartridge 20.

Referring to FIG. 3, the first cartridge 10 may include a rotation shaft 40 that protrudes upward. The rotation shaft 40 may protrude from the first cartridge 10 and extend upward, and the second cartridge 20 may be rotatably coupled to the rotation shaft 40.

A mouthpiece 26 including an outlet 26*e* for discharging the aerosol passing through the second material 22 of at least one of the chambers 21 to the outside may be coupled to the upper portion of the second cartridge 320. An upper plate 27 that covers upper ends of the chambers 21 may be arranged above the chambers 21. The upper plate 27 may include an upper through hole 27*p* through which the aerosol passes.

A flow guide 29 may be coupled to the upper end of the rotation shaft 40 that protrudes from the top surface of the upper plate 27. The flow guide 29 may be arranged inside the mouthpiece 26 and may guide the flow of the aerosol passing through the second material 22 of the chambers 21 to the outlet 26*e* of the mouthpiece 26. The flow guide 29 may include a plurality of wings corresponding to the plurality of chambers 21, respectively.

In a state in which the first cartridge 10 and the second cartridge 20 are coupled to each other, the relative positions of the first cartridge 10 and the second cartridge 20 may be changed so that at least one of the plurality of chambers 21 of the second cartridge 20 corresponds to the delivery hole 11 of the first cartridge 10. Thus, the aerosol discharged from the delivery hole 11 of the first cartridge 10 may pass through the second material 22 accommodated in a chamber, among the plurality of chambers 21 of the second cartridge 20, corresponding to the delivery hole 11. While the aerosol passes through the second material 22, the characteristics of the aerosol may be changed.

The aerosol generating device may further include a driving device 60 that generates a driving force so as to move at least one of the first cartridge 10 and the second cartridge 20. Referring to FIGS. 1 and 3, the driving device 60 may include a motor 61 that is arranged inside the case 7 and operates by an electrical signal, and a gear 62 that transmits the driving force of the motor 61 to the second cartridge 20. A gear surface 20*g* that extends in the rotation direction of the second cartridge 20 may be provided outside the second cartridge 20.

When the aerosol generating assembly 5 is mounted on the case 7, the gear surface 20*g* of the second cartridge 20 may be coupled to the gear 62. When an electrical signal is applied from the controller 70 to the motor 61 of the driving device 60, a shaft of the motor 61 may rotate, and a driving force of the motor 61 may be transmitted to the gear surface 20*g* of the second cartridge 20 through the gear 62. Thus, the driving device 60 rotate the second cartridge 20 with respect to the first cartridge 10.

Embodiments are not limited by the configuration of the driving device 60 shown in FIGS. 1 and 3, and for example, the driving device 60 may be connected to the first cartridge 10 so as to rotate the first cartridge 10. In addition, the gear 62 of the driving device 60 may be replaced with various power transmission elements such as a belt, a sprocket, and the like.

Here, an operation state that the position of at least one of the plurality of chambers 21 of the second cartridge 20 corresponds to the position of the delivery hole 11 of the first cartridge 10, may include all of the state where the position of any one of the plurality of chambers 21 corresponds to the position of the delivery hole 11 of the first cartridge 10 and the state where the positions of two adjacent chambers 21 of the plurality of chambers 21 correspond to the position of the delivery hole 11 of the first cartridge 10.

Referring to FIGS. 1 and 2, the second cartridge 20 may include a first mark 91 provided on its outer surface. The second cartridge 20 may include the plurality of chambers 21 therein, and the first mark 91 of the second cartridge 20 may be formed at a position corresponding to each of the chamber 21.

The first cartridge 10 may include a second mark 92, on the outer surface of the first cartridge 10, which may be used as a reference position regarding the first mark 91 of the second cartridge 20. Thus, the first mark 91 of the second cartridge 20 may coincide with the second mark 92 of the first cartridge 10 so that the position of at least one of the chambers 21 may be aligned with the position of the delivery hole 11 of the first cartridge 10 through which the aerosol is discharged.

Also, the user may check the positions of the first mark 91 of the second cartridge 20 and the second mark 92 of the first cartridge 10 to identify information regarding a chamber for currently passing the aerosol among the chambers 21 of the second cartridge 20.

A position sensor 97 may be installed between the second cartridge 20 and the first cartridge 10 and may represent the type of the second material 22 included in a corresponding one of the plurality of chambers 21, through which the aerosol currently passes according to the relative positions of the first cartridge 10 and the second cartridge 20. The position sensor 97 may detect the position of at least one of the chambers 21 based on the delivery hole 11 to generate a signal.

The position sensor 97 may include a transmitter 97*a* that is arranged in the cartridge 20, and one or more receivers 97*b* that are arranged in the first cartridge 10 and detect the transmitter 97*a*. Embodiments are not limited by the arrangement positions or the number of sensors 97*a* and receivers 97*b*, and for example, the transmitter 97*a* may be arranged in the first cartridge 10, and the receiver 97*b* may be arranged in the second cartridge 20.

When the position of at least one of the chambers 21 is aligned to correspond to the delivery hole 11, the position sensor 97 may generate an identification signal corresponding to the aligned chamber that is different from identification signals corresponding to non-aligned chambers.

The transmitter 97*a* and the receiver 97*b* of the position sensor 97 may be implemented by any one or any combination of, for example, an optical detection sensor such as a photocoupler, a magnetic sensor that detects magnetism by using a hall effect, an electrical resistance sensor that detects changes in electrical resistance, and a switch that generates a signal by a physical contact.

A remaining amount sensor 79*r* may be mounted in the case 7, and may detect the remaining amount of the first material 12 accommodated in the first cartridge 10 to generate a signal indicating the remaining amount of the first material 12. The remaining amount sensor 79*r* may be implemented by any one or any combination of a capacitive sensor, an ultrasonic wave sensor, and an optical sensor. As the remaining amount of the first material 12 accommodated in the first cartridge 10 is changed, a height H of the first material 12 accommodated in the first cartridge 10 may be changed, and the remaining amount sensor 79*r* may detect changes in the height H of the first material 12. A transparent window 10*w* may be formed in the case 7 such that user may check the remaining amount of the first material 12 accommodated in the first cartridge 10.

Referring to FIGS. 1 and 3, a puff sensor 79*f* may be arranged on a path on which the aerosol flows, inside the case 7. The puff sensor 79*p* may detect a flow phenomenon of the aerosol generated in association with the user's aerosol inhalation operation. The puff sensor 79*p* may be connected to the delivery hole 11, for example, thereby detecting fluctuations in fluid pressure or flow rate due to the flow of air, i.e., a fluid including the aerosol flowing through the delivery hole 11 to generate a signal. The puff sensor 79*p* may be arranged in a pressure detection hole 79*s* connected to the delivery hole 11.

When the aerosol generating device according to the embodiment is operated, the aerosol may flow from the first cartridge 10 to the chambers 21 of the second cartridge 20, and then may pass through the second material 22 accommodated in the chambers 21. The second material 22 may provide flavor to the aerosol. The aerosol passing through the second material 22 and including rich flavor may pass through the upper through hole 27*p* of the upper plate 27 arranged above the chambers 21 and then may be discharged to the outside of the aerosol generating device through the mouthpiece 26.

The controller (e.g., a processor, a control processing unit, etc.) 70 may identify a usage chamber, among the chambers 21, that is aligned to correspond to the position of the delivery hole 11 to be used to pass the aerosol, based on the signal of the position sensor 97. Here, the 'usage chamber' is a name that refers to one of the chambers 21, and is a term used to refer to at least one chamber in use to be aligned to correspond to the position of the delivery hole 11 among the chambers 21 and to perform a function of passing the aerosol.

When pre-set conditions are achieved, the controller 70 may operate the driving device 60 to change the relative positions of the first cartridge 10 and the second cartridge 20 so that at least one of the chambers 21 may pass the aerosol delivered from the first cartridge 10. That is, the second material 22 included in the chambers 21 of the second cartridge 20 may have a pre-set usage time regarding an operation of passing the aerosol, and when an actually-used time used to perform an operation of passing the aerosol through the second material 22 reaches the pre-set usage time, positions of the chambers 21 passing the aerosol need to be changed.

The pre-set conditions as a criterion for changing the relative position of the second cartridge 20 with respect to the first cartridge 10 by using the controller 70 may be determined by a signal of the remaining amount sensor 79*r*. That is, the controller 70 may determine the consumption amount of the first material 12 of the first cartridge 10 with respect to the usage chamber currently passing the aerosol among the chambers 21 based on the signal generated from the remaining amount sensor 79*r* and may compare the consumption amount of the first material 12 with a reference consumption amount of the first material 12 that is pre-set with respect to the usage chamber, thereby determining a position changing time at which changing of the position of the second cartridge 20 with respect to the first cartridge 10 is required.

The controller 70 may change the relative position of the second cartridge 20 with respect to the first cartridge 10, thereby selecting another one of the chambers 21 of the second cartridge 20 or the adjacent chambers 21 so as to pass the aerosol.

When the amount of the second material 22 accommodated in each of the chambers 21 of the second cartridge 20 is the same, a reference consumption amount of the first material 12 corresponding to each of the chambers 21 may be set to be same with respect to all of the chambers 21. For example, when the number of chambers 21 is three, the reference consumption amount of the first material 12 corresponding to each of the chambers 21 may be pre-set to about 33% by equally dividing the capacity of the first material 12 accommodated in the first cartridge 10.

However, embodiments are not limited by a method of setting the reference consumption amount of the first material 12 corresponding to each of the chambers 21 of the second cartridge 20, and the reference consumption amount of the first material 12 corresponding to each of the chambers 21 may be differently set. For example, when the amount of the second material 22 included in each of the chambers 21 is different or the material thereof is different or the size of particles thereof is different, the reference consumption amount of the first material 12 pre-set with respect to each of the chambers 21 may be differently set.

When the reference consumption amount of the first material 12 pre-set with respect to each of the chambers 21 is differently set, time at which each of the chambers 21 is used as a usage chamber for passing the aerosol, may be different. However, when the size of particles of the second material 22 of each of the chambers 21 is different or the characteristics of a material for the second material 22 are different, the consumption amount of the first material 12 within a unit time while the aerosol is passed may be different, and even when the reference consumption amount of the first material 12 with respect to each of the chambers 21 is different, time at which each of the chambers 21 is used as the usage chamber, may be the same.

Referring to FIG. 2, stoppers 81*a* and 81*b* may be installed between the first cartridge 10 and the second cartridge 20 and may limit changes in the relative positions of the first cartridge 10 and the second cartridge 20. The stoppers 81*a* and 81*b* may be arranged on a movement path of the chambers 21 between the first cartridge 10 and the second cartridge 20. The stoppers 81*a* and 81*b* may limit or restrict a relative motion of the second cartridge 20 with respect to the first cartridge 10. The relative motion of the second cartridge 20 with respect to the first cartridge 10 is for changing positions of the chambers 21 with reference to the delivery hole 11. Here, the 'movement path' of the chambers 21 does not mean a physical path through which the chambers 21 pass, but refers to a path in a circumferential direction along which outer edges on which the stoppers 81*a* and 81*b* of the second cartridge 20 are installed, move along a path in which the chambers 21 move in the circumferential direction as the second cartridge 20 rotates.

FIG. 4 is a block diagram schematically illustrating a connection relationship between some components of an aerosol generating device according to the embodiment of FIG. 1.

The controller 70 shown in FIG. 4 may be implemented by any one or any combination of a circuit board arranged inside the case 7 shown in FIGS. 1 and 3, a semiconductor chip attached to the circuit board, and software mounted on the semiconductor chip or the circuit board, a processor, a microprocessor, and a control processing unit (CPU).

The controller 70 may include an atomization controller 71 that controls the generation amount or temperature of the aerosol by controlling the atomizer 50*a*, a sensor controller (including a sensing data receiver) 74 that controls the temperature sensor 79*t*, the puff sensor 79*p*, the position sensor 97, and the remaining amount sensor 79*r*, and receives a signal of the temperature sensor 79*t* for detecting the temperature regarding the atomizer 50*a*, a signal of the puff sensor 79*p* for detecting changes in pressure or speed of the air generated when the user inhales the aerosol, a signal generated by the position sensor 97 shown in FIG. 2 by detecting the rotation position of the second cartridge 20 with respect to the first cartridge 10 and a signal of the remaining amount sensor 79*r* for detecting the remaining amount of the first material 12 accommodated in the first cartridge 10, an information controller 75 that controls the information generator 96 for providing information to the user or notifying a notification, a user input receiver 76 that receives the user's input signal from the input device 95 such as an user input device, for example, a button for detecting the user's input operation, a touch screen, or an input button, an input/output controller 73 that exchanges data with a storage unit (e.g., a storage or a memory) 78 including or storing information about the type of the first material of the first cartridge 10 or the type of the second material in the second cartridge 20, a temperature profile for controlling the operating temperature of the atomizer 50*a* or information about the user, or information regarding the positions of the chambers 21 with respect to the delivery hole 11 according to changes in relative positions of the first cartridge 10 and the second cartridge 20 and the reference consumption amount of the first cartridge 20 pre-set with respect to each of the chambers 21 of the second cartridge 20, a medium determining unit 72 that determines a usage chamber currently in use to pass the aerosol based on the signal received from the position sensor 97 and the type of a medium included in the usage chamber, a consumption amount calculator 78*a* that determines the consumption amount at which the first material 12 of the first cartridge 10 with respect to the usage chamber for currently passing the aerosol among the chambers 21 based on the signal generated by the remaining amount sensor 79*r* and compares the consumption amount of the first material 12 with the reference consumption amount of the first material 12 pre-set with respect to the usage chamber, thereby determining a position changing time at which changing of the position of the second cartridge 20 with respect to the first cartridge 10 is required, and a driving controller 77 that controls the operation of the driving device 60.

The controller 70 described above may detect the user's inhalation, thereby starting or stopping the operation of the atomizer 50*a*. In addition, the controller 70 may determine the usage chamber currently in use (hereinafter, "current usage chamber") to pass the aerosol based on the signal applied from the position sensor 97 and the type of a medium included in the usage chamber and may control the operating temperature or operating time of the atomizer 50*a* to be suitable for the type of the medium. In addition, the controller 70 may determine the consumption amount at which the first material 12 of the first cartridge 10 is consumed with respect to the current usage chamber based on the signal detected by the remaining amount sensor 79*r* and may compare the determined consumption amount with the reference consumption amount, thereby determining a position changing time at which changing of the position of the second cartridge 20 with respect to the first cartridge 10 is required.

After determining the current usage chamber based on the signal applied from the position sensor 97 and the type of the medium included in the usage chamber, the controller 70 may output information about the type of the usage chamber, i.e., a preset identification number of the usage chamber to the information generator 96. The pre-set identification number of the usage chamber may include, for example, a number, a character, or a symbol. Also, the controller 70 may output information about the type of the medium included in the usage chamber, for example, the name of the medium, the characteristics of the medium, i.e., information about flavor or information about a used lifetime to the information generator 96.

The controller 70 may determine a changing time at which position changing is required, and then the controller 70 may change the relative position of the second cartridge 20 with respect to the first cartridge 10 by operating the driving device 60 immediately at the position changing time.

Alternatively, after determining the position changing time at which position changing is required, the controller 70 may output a replacement notification to the information generator 96 for notifying a state in which position changing of the chambers 21 of the second cartridge 20 is required to the user. When the user's input instruction for changing the positions of the chambers 21 is received through the input device 95, the controller 70 may operate the driving device 60 to change the relative position of the second cartridge 20 with respect to the first cartridge 10.

Also, the controller 70 may operate the driving device 60 when another plurality of pre-set conditions are achieved. Another plurality of pre-set conditions may be different conditions from those of the position changing time. For example, another plurality of pre-set conditions for changing the relative position of the first cartridge 10 and the second cartridge 20 by operating the driving device 60 by using the controller 70 may include a cumulative time of a heating operation of heating heat by using the heater so as to generate an aerosol, or a combination of the cumulative time of the heating operation of the heater and the heating temperature of the heater.

When the position changing time is determined or another plurality of pre-set conditions are achieved, the controller 70 may first generate a replacement notification that notifies changes in the relative positions of the first cartridge 10 and the second cartridge 20 is required, through the information generator 96. When the user checks the notification and manipulates the input device 95, the controller 70 may operate the driving device 60 based on the input signal applied from the input device 95 so as to change the relative positions of the first cartridge 10 and the second cartridge 20.

When another plurality of pre-set conditions include the cumulative time of the heating operation of the heater, the controller 70 may calculate the amount of current or the amount of power supplied to the heater by using the atomization controller 70 or may calculate the cumulative time of the heating operation of the heater by summing up the time at which current is supplied to the heater. For example, in a case in which a time at which flavors may be imparted to an aerosol while the aerosol passes through the second material 22 included in one of the chambers 21 of the second cartridge 20 is previously determined as n minutes, when the cumulative time of the heating operation of the heater reaches the n minutes, the controller 70 may determine that use of the chamber through which an aerosol passes has to be terminated and change the relative position of the second cartridge 20 with respect to the first cartridge 10 to select a new chamber for passing the aerosol from among the chambers 21. Here, "n" denotes a natural number, an integer, or a length of time.

The heating operation of the heater may include a main heating operation of generating heat at a sufficient temperature to vaporize the first material of the first cartridge 10, and a pre-heating operation of generating heat in a range of temperature that is lower than temperature corresponding to the main heating operation. The heating operation of the heater included in other pre-set conditions for operating the driving device 60 by using the controller 70 may be the main heating operation.

The case where other pre-set conditions include a combination of the cumulative time of the heating operation of the heater and the heating temperature of the heater may be more useful when the heating operation of the heater includes the main heating operation and the pre-heating operation. For example, when the time at which the aerosol passes through the second material included in one of the chambers 21 and flavor may be provided to the aerosol is pre-set to n minutes, the controller 70 may count the cumulative time of the heating operation of the heater only when the heating temperature of the heater reaches a temperature corresponding to the main heating operation.

Also, under the conditions different from those of the position changing time, the controller 70 may operate the driving device 60 to change the relative positions of the first cartridge 10 and the second cartridge 20. The different conditions may include selection conditions under which at least one of the chambers 21 is selected based on an input signal generated by receiving the user's input by using the input device 95 is selected.

The chambers 21 of the second cartridge 20 may include the second material 22 having a different medium type or different particle size. The controller 70 may control the display lamp 7*d* to emit a light of a certain emission color or to change the emission color, or may control the display device 7*f* to display visual information, thereby providing information about the second material 22 accommodated in the current usage chamber that is aligned in the position of the delivery hole 11 of the first cartridge 10 to pass the aerosol to the user.

When the user selects a chamber to be used among the chambers 21 by manipulating the input device 95, the controller 70 may determine that the selection conditions on which the user selects at least one chamber of the chambers 21 are achieved, based on the input signal input from the input device 95, and change the relative positions of the first cartridge 10 and the second cartridge 20.

When the aerosol generating device described above is used, before the user inserts the aerosol generating assembly 5 into the case 7, the rotation position of the second cartridge 20 may be adjusted so that the second cartridge 20 may be rotated with respect to the first cartridge 10 and thus the position of at least one of the chambers 21 of the second cartridge 20 may correspond to a position corresponding to the delivery hole 11 of the first cartridge 10. After the relative positions of the first cartridge 10 and the second cartridge 20 are adjusted, the user may be able to insert the aerosol generating assembly 5 into the case 7.

In another embodiment, the user may be allowed to insert the aerosol generating assembly 5 into the case 7 without the need of adjusting the relative positions of the first cartridge 10 and the second cartridge 20. For example, the driving device 60 may automatically rotate the second cartridge 20 to adjust the relative positions of the first cartridge 10 and the second cartridge 20 to an initial position for aerosol generation. The 'initial position' may be a position at which the position of any one of the chambers 21 of the second cartridge 20 corresponds to the position of the delivery hole 11.

In a state in which the position of at least one of the chambers 21 of the second cartridge 20 corresponds to the position of the delivery hole 11 of the first cartridge 10, the user may inhale the aerosol through the mouthpiece 26.

The aerosol generating assembly 5 of the aerosol generating device may be handled as one device in which the first cartridge 10 for accommodating the first material 12 and the second cartridge 20 for accommodating the second material 22 are integrated and thus, is convenient to carry and use.

In addition, even when the first cartridge 10 of the aerosol generating device is designed to accommodate a large amount of the first material 12, the second cartridge 20 may be automatically rotated by the driving device 60 to select the chambers 21 used for supplying the aerosol, so that the effect of replacing the second cartridge including the second material 22 with a new second material 22 may be obtained without replacing the second cartridge including the second material 22.

In addition, the chambers 21 of the second cartridge 20 may include different types of second materials 22. For example, the chambers 21 may include the second materials 22 having different particle sizes or different flavor properties. Even when the chambers 21 include different types of the second materials 22, the controller 70 may identify the 'usage chamber, among the chambers 21, currently in use to pass the aerosol by being aligned to correspond to the delivery hole 11 of the chambers 21' based on the signal generated by the position sensor 97. Because information about the usage chamber identified by the controller 70 and information about the second material 22 included in the usage chamber may be provided to the user, the user may select a desired second material 22 by selecting one among the chambers 21, thereby freely enjoying the aerosol having various flavors.

In addition, because a consumption amount of the first material 12 of the first cartridge 10 with respect to the usage chamber in use to pass the aerosol among the chambers 21 of the second cartridge 20 is determined based on the signal of the remaining amount sensor 79*r* and the consumption amount is compared with the reference consumption amount so that the position changing time for changing the positions of the chambers 21 may be determined, convenience regarding an operation of changing the positions of the plurality of chambers 21 may be increased. That is, when the positions of the chambers 21 are automatically changed at the position changing time determined based on the signal of the remaining amount sensor 79*r*, the user does not need to perform separate manipulation so as to change the positions of the chambers 21, the use of the aerosol generating device is convenient.

In addition, because, after a replacement notification for guiding change of the positions of the chambers 21 is informed to the user at the position changing time, the user may change the positions of the chambers 21 based on the user's input manipulation, during the use of the aerosol generating device, the degree of freedom of the user's selection regarding the use and position changing of the chambers 21 is increased.

FIG. 5 is a cross-sectional view schematically illustrating some components of an aerosol generating device according to another embodiment.

In the aerosol generating device according to the embodiment of FIG. 5, the remaining amount sensor 79*r* for detecting the remaining amount of the first material 12 accommodated in the first cartridge 10 may be implemented by the optical sensor. The remaining amount sensor 79*r* may include an emitting unit (e.g., a light emitter, a light source, etc.) 79*a* that emits light from a first side of the first cartridge 10 toward a second side (e.g., the opposite side of the first side) of the first cartridge 10 to have the emitted light pass through the first material 12, and a plurality of light receiving units 79*b* that are provided on the second side of the first cartridge 10 and receive light that is transmitted from the light emitting unit 79*a* and passes through the first material 12 to generate a signal.

The controller 70 or the storage unit 78 may store, in advance, information about relationship between the change the amount of light incident on each of the plurality of light receiving units 79*b* according to changes in the remaining amount of the first material 12 inside the first cartridge 10 and changes in the signal of the light receiving units 79*b*, and may detect changes in the remaining amount of the first material 12 based on changes in signals of the plurality of light receiving units 79*b*.

FIG. 6 is a cross-sectional view schematically illustrating some components of an aerosol generating device according to another embodiment.

In the aerosol generating device according to the embodiment of FIG. 6, the remaining amount sensor 79*r* for detecting the remaining amount of the first material 12 accommodated in the first cartridge 10 may be implemented by the optical sensor. Unlike the aerosol generating device according to the embodiment of FIG. 5, in FIG. 6, the emitting unit 79*a* and the plurality of light receiving units 79*b* of the remaining amount sensor 79*r* may be arranged together at one side of the first cartridge 10. Thus, light L1, L3, and L3 emitted from the emitting unit 79*a* may be converted into reflected light in which the light emitted from the emitting unit 79*a* is partially reflected by the first material 12, or scattered light in which the light emitting from the emitting unit 79*a* is scattered by the first material 12, and thus the light may be incident on the light receiving units 79*b*.

The amount of scattered light incident on each of the plurality of light receiving units 79*b* may vary according to the level of the first material 12 remaining in the first cartridge 10. The controller 70 or the storage unit 78 may store, in advance, information about relationship between the change the amount of scattered light incident on each of the plurality of light receiving units 79*b* according to changes in the remaining amount of the first material 12 inside the first cartridge 10 and changes in the signal of the light receiving units 79*b*, and may detect changes in the remaining amount of the first material 12 based on changes in signals of the plurality of light receiving units 79*b*.

FIG. 7 is a perspective view schematically illustrating some components of an aerosol generating device according to another embodiment.

In the aerosol generating device according to the embodiment of FIG. 7, the aerosol generating assembly 5 may include a first cartridge 10, and a second cartridge 20 that is rotatably coupled to the first cartridge 10. The first cartridge 10 may be provided with a driving device 60, and the driving device 60 may rotate the second cartridge 20 so that the relative position of the second cartridge 20 with respect to the first cartridge 10 may be changed.

A remaining amount sensor 79*r* for detecting the remaining amount of the first material 12 accommodated in the first cartridge 10 may be installed in the first cartridge 10. The remaining amount sensor 79*r* may include a probe 179*a* inserted into the first material 12 of the first cartridge 10, and a conducting wire and terminal assembly 179*b* electrically connected to the probe 179*a*. For example, the remaining amount sensor 79*r* may be implemented by the capacitive sensor. That is, the remaining amount sensor 79 may detect changes in capacitance that varies as the height of the first material 12 accommodated in the first cartridge 10 is changed. Because the controller 70 is electrically connected to the remaining amount sensor 79*r*, the controller 70 may detect changes in capacitance according to changes in the remaining amount of the first material 12 accommodated in the first cartridge 10 by using the remaining amount sensor 79*r*, thereby detecting changes in the remaining amount of the first material 12.

The first cartridge 10 may include a plurality of storage units partitioned so that each of the plurality of storage units may accommodate the first material 12, and a plurality of delivery holes 11 formed to correspond to the plurality of storage units. In the aerosol generating device according to the embodiment of FIG. 7, the first cartridge 10 includes two storage units and two delivery holes 11. However, embodiments are not limited by the configuration of the first cartridge 10, and the number of storage units and the number of delivery holes 11 may be variously modified.

The aerosol generated by vaporizing the first material 12 included in the plurality of storage units, may be delivered to the second cartridge 20 via the plurality of delivery holes 11 of the first cartridge 10. When the aerosol is generated in the first cartridge 10, the first material 12 of all storage units of the first cartridge 10 may be simultaneously vaporized, and in some cases, the first material 12 may be vaporized in only one of the plurality of storage units, or the first material 12 may be vaporized in a plurality of the plurality of storage units.

The second cartridge 20 may include a plurality of chambers 21 for accommodating the second material 22 through which the aerosol delivered from the first cartridge 10 passes and is discharged to the outside. The first cartridge 10 and the second cartridge 20 may be integrally coupled to each other to form an aerosol generating assembly 5 so as to be handled as one integrated component.

A position sensor 97 may be installed between the first cartridge 10 and the second cartridge 20 and may detect the position of at least one of the chambers 21 based on the delivery hole 11 to generate a position signal.

The position sensor 97 may include transmitters 97*a* that are spaced apart from each other in the rotation direction of the second cartridge 20, i.e., in the circumferential direction and receivers 97*b* that are arranged in the first cartridge 10 and detect the transmitters 97*a*. Embodiments are not limited by the arrangement positions or the number of transmitters 97*a* and receivers 97*b*, and for example, the transmitters 97*a* may be arranged in the first cartridge 10, and the receivers 97*b* may be arranged in the second cartridge 20.

In FIG. 7, one transmitter 97*a* may be arranged at a position corresponding to each of the chambers 21 of the second cartridge 20, and one transmitter 97*a* may also be arranged at a position between the adjacent chambers 21. Among the plurality of transmitters 97*a*, the transmitter 97*a* corresponding to each of the chambers 21 of the second cartridge 20 may generate a signal indicating that the corresponding chamber is individually aligned at the position of the delivery hole 11. Also, the transmitter 97*a* arranged between the adjacent chambers 21 may generate a signal indicating that the adjacent chambers 21 are aligned with respect to the position of the delivery hole 11 at the same time so that the adjacent chambers 21 together perform a function of a usage chamber for passing the aerosol.

Embodiments are not limited by the arrangement positions and the number of transmitters 97*a* of the position sensor 97, and for example, the transmitters 97*a* may be arranged to correspond to only one of the chambers 21, respectively.

FIG. 8 is a latitudinal cross-sectional view illustrating one operating state of the aerosol generating device according to the embodiment of FIG. 7.

The second cartridge 20 may be rotated by the driving device so that the relative position of the second cartridge 20 with respect to the first cartridge 10 may be changed. As shown in FIG. 8, the rotation position of the second cartridge 20 with respect to the first cartridge 10 may be aligned so that the position of one of the chambers 21 of the second cartridge 20 may correspond to the position of one delivery hole 11. In the alignment state shown in FIG. 8, one of the chambers 21 of the second cartridge 20 passes the aerosol delivered from one delivery hole 11 of the first cartridge 10 so that the function of the usage chamber for changing the characteristics of the aerosol may be performed.

FIG. 9 is a latitudinal cross-sectional view illustrating another operating state of the aerosol generating device according to the embodiment of FIG. 7.

When the consumption amount of the first material of the first cartridge 10 exceeds the pre-set reference consumption amount with respect to the current usage chamber of the second cartridge 20, the controller 70 may determine a position changing time at which changing of the position of the second cartridge 20 with respect to the first cartridge 10 is required. The controller 70 may control the driving device by the user's selection or immediately after the position changing time, thereby changing the positions of the chambers 21 of the second cartridge 20.

The second cartridge 20 may be rotated by the driving device so that, when the relative position of the second cartridge 20 with respect to the first cartridge 10 is changed, as shown in FIG. 9, the rotation position of the second cartridge 20 with respect to the first cartridge 10 may be aligned so that the positions of the adjacent chambers 21 may correspond to the position of one delivery hole 11. In FIG. 9, each of two adjacent chambers among the chambers 21 of the second cartridge 20 may be positioned to overlap a region corresponding to half of one delivery hole 11. Embodiments are not limited by the alignment position of the second cartridge 20, and the rotation position of the second cartridge 20 with respect to the first cartridge 10 may be aligned so that the areas in which two adjacent chambers among the chambers 21 overlap the delivery hole 11 may be different from each other.

For example, when a lifetime regarding a function of passing the aerosol through the second material 22 included in one of the two adjacent chambers 21 reaches 20%, the area of one of the two adjacent chambers 21 may overlap the area corresponding to about 80% of the delivery hole 11, and the area of the other one of the two adjacent chambers 21 may overlap the area corresponding to about 20% of the delivery hole 11.

For example, when a lifetime regarding a function of passing the aerosol through the second material 22 included in one of the two adjacent chambers 21 reaches 60%, the area of one of the two adjacent chambers 21 may overlap the area corresponding to about 40% of the delivery hole 11, and the area of the other one of the two adjacent chambers 21 may overlap the area corresponding to about 60% of the delivery hole 11.

Also, when a lifetime regarding a function of passing the aerosol through the second material 22 included in one of the two adjacent chambers 21 reaches 80%, the area of one of the two adjacent chambers 21 may overlap the area corresponding to about 20% of the delivery hole 11, and the area of the other one of the two adjacent chambers 21 may overlap the area corresponding to about 80% of the delivery hole 11.

The lifetime regarding a function of passing the aerosol through the second material 22 accommodated in the chambers 21 of the second cartridge 20 may be determined by pre-set conditions used by the controller 70 so as to change the relative positions of the first cartridge 10 and the second cartridge 20, as described above. The pre-set conditions may include the position changing time determined based on comparison of the consumption amount of the first material of the first cartridge detected by the remaining amount sensor and the reference consumption amount.

Also, as described above, when the area of the adjacent chambers 21 overlapping the delivery hole 11 is changed by rotating the second cartridge 20 based on the lifetime of the second material 22 of the chambers 21, the second cartridge 20 may be intermittently moved according to a change of time, or the second cartridge 20 may be consecutively moved according to a change of time.

As shown in FIG. 9, according to a method, whereby the positions of adjacent chambers of the plurality of chambers 21 of the second cartridge 20 are aligned to overlap one delivery hole 11, while the second cartridge 20 is rotated with respect to the first cartridge 10, an aerosol may be generated in the first cartridge 10, and an operation of allowing the aerosol to flow without stopping an operation of delivering the aerosol to the second cartridge 20 may be continuously maintained.

Also, the relative positions of the first cartridge 10 and the second cartridge 20 may be changed so that a chamber for passing the aerosol among the plurality of chambers 21 may be sequentially selected. When the second cartridge 20 rotates by selecting a chamber through which the aerosol passes from among the plurality of chambers 21, the position of the previous chamber through which the aerosol currently passes may not immediately depart from the delivery hole 11, and an operation of passing the aerosol through the previous chamber and a subsequent chamber simultaneously, which are subsequently aligned with the position of the delivery hole 11 due to the rotational motion of the second cartridge 20 may be performed.

According to this operating method, while the relative positions of the first cartridge 10 and the second cartridge 20 are changed, the characteristics such as temperature, humidity and flavors of the aerosol delivered to the user may not be rapidly changed so that steady and stable supply of the aerosol is possible.

Also, when each of the plurality of chambers 21 of the second cartridge 20 includes the second material 22 having different characteristics, the adjacent chambers may pass the aerosol together so that the characteristics such as ingredients and flavors of the aerosol may be variously modified and thus various types of aerosols may be provided to the user.

FIG. 10 is a perspective view schematically illustrating some components of an aerosol generating device according to another embodiment.

The aerosol generating device according to the embodiment of FIG. 10 may include a first cartridge 10 including storage units l0*a* and 10*b* each independently partitioned and accommodating the first material, a second cartridge 20 that is coupled to the first cartridge 10 to be movable linearly or laterally, a driving device 60 that moves the second cartridge 20 linearly or laterally, and a remaining amount sensor 79*r* that detects the remaining amount of the first material accommodated in the first cartridge 10 to generate a signal.

The first cartridge 10 may include passages 11*p* and 11*q* for delivering the aerosol generated by vaporizing the first material accommodated in each of the storage units 10*a* and 10*b*, and a delivery hole 11 formed in an end of each of the passages 11*p* and 11*q*.

The remaining amount sensor 79*r* may include electrodes 279*a* arranged in each of the storage units 10*a* and 10*b* of the first cartridge 10, a conducting wire 279*b* and a connector 279*c* connected to the electrodes 279*a*. The electrodes 279*a* may be arranged in pairs at positions with different heights of the storage units 10*a* and 10*b* of the first cartridge 10 so that capacitance may be changed according to the height of the first material. The controller 70 may detect changes in capacitance when electricity flows through the electrodes 279*a*, to detect the remaining amount of the first material accommodated in the first cartridge 10.

The first cartridge 10 may include a linear guide 10*t* that surrounds the upper portion of the delivery hole 11 and extends linearly, and the second cartridge 20 may include a rail 201 that is slidably coupled to the linear guide 10*t*. The second cartridge 20 may be linearly moved in the extension direction of the linear guide 10*t* of the first cartridge 10. The second cartridge 20 may include a main body 20*t* that is plate-shaped and that extends long in the extension direction of the linear guide 10*t* and a plurality of chambers 20*a*, 20*b*, and 20*c* arranged to be sequentially apart from each other along the extension direction of the main body 20*t*.

In FIG. 10, two storage units 10*a* and 10*b* are arranged, and three chambers 20*a*, 20*b*, and 20*c* are arranged. However, the number of storage units and the number of chambers may be variously modified.

The aerosol generating device may include a driving device 60 that generates a driving force to move at least one of the first cartridge 10 and the second cartridge 20. The driving device 60 may include a motor 61 that operates by an electrical signal, and a gear 62 that transmits the driving force of the motor 61 to the second cartridge 20. A gear surface 20*g* may be mounted at one side of the main body 20*t* of the second cartridge 20.

In FIG. 10, the driving device 60 is illustrated as an electric motor for generating a rotational force for rotating the gear 62. However, embodiments are not limited by the type of the driving device 60. For example, the driving device 60 may include a permanent magnet linearly arranged, a linear motor including an electromagnet positioned to correspond to the permanent magnet and having an electric coil, or a cylinder using the pressure of a fluid.

As the second cartridge 20 is linearly moved, the position of any one of the chambers 20*a*, 20*b*, and 20*c* of the second cartridge 20 or the positions of the adjacent chambers may be aligned to correspond to the position of one delivery hole 11. Also, the position of one group of the chambers 20*a*, 20*b*, and 20*c* of the second cartridge 20 may be aligned to correspond to the position of one of two delivery holes 11, and simultaneously, and the position of another group among the chambers 20*a*, 20*b*, and 20*c* may be aligned to correspond to the position of the other one of two delivery holes 11.

A position sensor 97 may be installed between the first cartridge 10 and the second cartridge 20 and may detect the position of at least one of the chambers 20*a*, 20*b*, and 20*c* with respect to the delivery hole 11 to generate a signal.

The position sensor 97 may include transmitters 97*a* arranged to be apart from each other in the direction of a linear motion of the second cartridge 20, and receivers 97*b* that are arranged in the first cartridge 10 and detect the transmitters 97*a*. Embodiments are not limited by the arrangement positions or the number of transmitters 97*a* and receivers 97*b*, and for example, the transmitters 97*a* may be arranged in the first cartridge 10, and the receivers 97*b* may be arranged in the second cartridge 20.

The transmitters 97*a* and the receivers 97*b* of the position sensor 97 may be implemented by any one or any combination of for example, an optical detection sensor such as a photocoupler, a magnetic sensor that detects magnetism by using a hall effect, an electrical resistance sensor that detects changes in electrical resistance, and a switch that generates a signal by a physical contact.

FIG. 11 is a longitudinal cross-sectional view schematically illustrating an aerosol generating device according to another embodiment, and the aerosol generating device according to the embodiment shown in FIG. 11 is similar to the aerosol generating device according to the embodiment shown in FIGS. 1 through 3.

The aerosol generating device according to the embodiment of FIG. 11 may include a handle 110 that the user may manually manipulate by replacing a driving device such as a motor so as to change the relative positions of the first cartridge 10 and the second cartridge 20, and a remaining amount sensor 79*r* that is installed in the first cartridge 10 and detects the remaining amount of the first material 12 accommodated in the first cartridge 10 to generate a signal.

The remaining amount sensor 79*r* may include electrodes 279*a* arranged in the first cartridge 10 and a conducting wire 279*b* and a connector 279*c* connected to the electrodes 279*a*. The electrodes 279*a* may be arranged in pairs at different heights of the first cartridge 10 and may detect changes in capacitance that varies according to the height of the first material. The controller 70 may detect changes in capacitance when electricity flows through the electrodes 279*a*, and may detect the remaining amount of the first material accommodated in the first cartridge 10.

The controller 70 may detect the consumption amount at which the first material 12 of the first cartridge 10 is used, with respect to the usage chamber currently in use to pass the aerosol among the chambers 21 of the second cartridge 20 based on the signal of the remaining amount sensor 79*r* and may compare the detected consumption amount with a pre-set reference consumption amount with respect to the usage chamber, thereby determining a position changing time at which changing of the second cartridge 20 with respect to the first cartridge 10 is required.

Also, the controller 70 may output a replacement notification indicating the determined position changing time through an information generator. The user may manipulate the handle 110 after checking the replacement notification, thereby setting a new chamber to a usage chamber by changing the positions of the chambers 21 of the second cartridge 20.

The handle 110 may be connected to a handle shaft 111 that is rotatably coupled to the case 7. A force transmission portion 113 may transmit the user's force applied to the handle 110, and may be mounted on the handle shaft 111. The force transmission portion 113 may be engaged with the gear surface 20*g* that extends in the rotation direction of the second cartridge 20 on an outside surface of the second cartridge 20. Although illustrated for simplicity in FIG. 11, the case 7 may include a mechanical element such as a bearing so as to rotatably support the handle shaft 111.

A switch 120 that generates a position signal indicating the positions of the chambers 21 according to changing of the relative position of the second cartridge 20 with respect to the first cartridge 10, may be installed at a lower end of the handle shaft 111 to which the force transmission portion 113 is connected. The switch 120 may be an example of a position sensor.

The switch 120 may include a transmitter 121 that is installed at a lower end of the handle shaft 11, and a receiver 122 that is arranged inside the case 7 and detects a signal transmitted from the transmitter 121. The installation position of the transmitter 121 may be variously modified, and the transmitter 121 may be arranged in the force transmission portion 113, for example.

The switch 120 may be implemented by any one or any combination of, for example, an optical detection sensor such as a photocoupler, a magnetic sensor that detects magnetism by using a hall effect, an electrical resistance sensor that detects changes in electrical resistance, and a switch that generates a signal by a physical contact.

Because at least a portion of the handle 110 is exposed to the outside of the case 7, when the user rotates the handle 110, the user's force may be transmitted to the gear surface 20*g* via the force transmission portion 113 and thus, the second cartridge 20 may be rotated.

In a state in which the position of at least one of the chambers 21 of the second cartridge 20 corresponds to the position of the delivery hole 11 of the first cartridge 10, the user may inhale the aerosol via the mouthpiece 26.

The user may manipulate the handle 110 to rotate the second cartridge 20. The controller 70 may identify a 'usage chamber, among the chambers 21, that is aligned to correspond to the position of the delivery hole 11 and is in use to pass the aerosol' based on the signal of the switch 120 while the second cartridge 20 is rotated.

The controller 70 may output and provide information on the usage chamber, among the chambers 21 of the second cartridge 20, that is currently aligned with the position of the delivery hole 11 of the first cartridge 10 and is used to pass, to the user through an information generator The user may manipulate the handle 110 to rotate the second cartridge 20 and simultaneously may check the information on the usage chamber output by the information generator and then may select a desired chamber to be used among the chambers 21.

Embodiments are not limited by a connection structure between the handle 110 for moving the second cartridge 20 and the second cartridge 20, shown in FIG. 11, and the structure of the handle 110 that the user may manipulate manually, and the connection structure between the handle 110 and the second cartridge may be variously modified. For example, the force transmission portion 113 may not be provided between the handle 110 and the second cartridge 20, and the handle 110 may be directly connected to the gear surface 20*g* of the second cartridge 20, or the handle 110 may be disposed on the outer surface of the second cartridge 20.

When the handle 110 is directly connected to the second cartridge 20 or the handle 110 is mounted in the second cartridge 20, a switch for generating a position signal indicating the positions of the chambers 21 according to changing of the rotation position of the second cartridge 20 may be installed in the handle 110.

FIG. 12 is a longitudinal cross-sectional view schematically illustrating a coupling relationship between some components of an aerosol generating device according to another embodiment.

An aerosol generating assembly 5 of the aerosol generating device according to the embodiment shown in FIG. 12 may include a first cartridge 10 in which a first material 12 for generating an aerosol is accommodated, a second cartridge arranged to be rotated with respect to the first cartridge 10, and a remaining amount sensor 79*r* for detecting the remaining amount of the first material 12 accommodated in the first cartridge 10.

The second cartridge 20 may include a rotation case 25 with a plurality of chambers 21 for accommodating the second material 22 through which the aerosol passes, and a mouthpiece 26 including an outlet 26*e* for discharging the aerosol passing through the second material 22 to the outside.

The first cartridge 10 may accommodate the first material 12 therein and may include a delivery hole 11 through which the aerosol generated from the first material 12 is transmitted to the second cartridge 20. The remaining amount sensor 79*r* for detecting the remaining amount of the first material 12 accommodated in the first cartridge 10 may be installed inside the first cartridge 10. The remaining amount sensor 79*r* may include a transmitter 379*a* that sends ultrasonic waves toward the surface of the first material 12, and a receiver 379*b* that receives a reflected wave reflected from the surface of the first material 12.

As shown in the embodiment shown in FIGS. 1 through 3, an atomizer may be installed in the first cartridge 10, or an atomizer may be installed inside a case on which the first cartridge 10 is mounted.

The second cartridge 20 may be arranged to be rotated with respect to the first cartridge 10 and may include a plurality of chambers 21 that are sequentially positioned in the rotation direction, a lower through hole 20*f*, which is positioned under the chambers 21 and through which the aerosol passes, and a second material 22, which is accommodated in each of the chambers 21 and through which the aerosol passes. The chambers 21 are partitioned by barrier walls 22*w* to be independent from each other.

Unlike in the embodiments shown in FIGS. 1 through 3 and FIG. 15, the aerosol generating assembly 5 of the aerosol generating device according to the embodiment shown in FIG. 12 may omit a rotation shaft for supporting the second cartridge 20. The second cartridge 20 and the first cartridge 10 may have a cylindrical shape, and a rotation guide 130 for guiding a rotation motion of the second cartridge 20 with respect to the first cartridge 10 may be provided between the second cartridge 20 and the first cartridge 10.

The rotation guide 130 may include a rail 131 that protrudes from the outer surface of the first cartridge 10 and extends in the circumferential direction of the first cartridge 10, and a circumferential groove 132, which extends in the circumferential direction of the second cartridge 20 on an inner surface of the second cartridge 20 and in which the rail 131 is accommodated and supported while the second cartridge 20 is rotated.

Embodiments are not limited by the configuration of the rotation guide 130 shown in FIG. 12, and for example, the circumferential groove 132 may be installed in the first cartridge 10, the rail 131 may be installed in the second cartridge 20, and the rotation guide 30 may include a bearing additionally installed between the second cartridge 20 and the first cartridge 10.

A position sensor 160 that generates a position signal by detecting the position of at least one of the chambers 21 with respect to the delivery hole 11 may be installed between the first cartridge 10 and the second cartridge 20.

The position sensor 160 may include a plurality of magnetic bodies 161, which are arranged in the second cartridge 20 to be apart from each other in the rotation direction, i.e., the circumferential direction of the second cartridge 20 and have magnetism with different strengths, and a hall sensor 162 that is arranged in the first cartridge 10 and detects the intensity of magnetism of the plurality of magnetic bodies 161. Embodiments are not limited by the arrangement positions or the number of magnetic bodies 161 and hall sensors 162, and for example, the magnetic bodies 161 may be arranged in the first cartridge 10, and the hall sensor 162 may be arranged in the second cartridge 20.

FIG. 13 is a flowchart schematically illustrating a method of generating an aerosol by using the aerosol generating device according to the embodiments of FIGS. 1 through 12, according to an embodiment.

The method of generating an aerosol according to the embodiment of FIG. 13 may include detecting a user's inhalation (operation S100), starting an operation of supplying an aerosol based on determination that the user's inhalation has been detected (operation S110), detecting a rotation position of the second cartridge with respect to the first cartridge (operation S120), determining whether a signal of the detected rotation position of the second cartridge is good (e.g., whether the amplitude of the signal or the signal-to-noise ratio (SNR) of the signal of the detected rotation position of the second cartridge is greater than a preset threshold value) (operation S130), when the signal of the detected rotation position of the second cartridge is not good, adjusting the rotation position of the second cartridge (operation S131), when the signal of the detected rotation position of the second cartridge is good, determining the type of a medium currently in use to supply the aerosol, (e.g.

the type of the second material based on the signal of the rotation position of the second cartridge) (operation S140), determining at least one of a target temperature for the operation of an atomizer and a heating profile for controlling a heating operation of the atomizer based on the determined type of the medium (operation S150), operating the atomizer based on the target temperature or the heating profile (operation S160), detecting a current temperature and comparing the current temperature with the target temperature (operation S170), detecting the remaining amount of the first material accommodated in the first cartridge to determine a consumption amount at which the first material is consumed with respect to a usage chamber to currently pass the aerosol and comparing the consumption amount of the first material with a reference consumption amount to determine a position changing time at which changing of the position of the second cartridge with respect to the first cartridge is required (operation S180), when the consumption amount exceeds the reference consumption amount and the position changing time is changed, checking whether the current usage chamber is the last chamber among a plurality of chambers of the second cartridge (operation S200), and when the current usage chamber is not the last chamber, changing relative positions of the first cartridge and the second cartridge (operation S190).

After the changing of the relative positions of the first cartridge and the second cartridge (operation S190) is performed, the method may return to the detecting of the user's inhalation (operation S100), and the above-described operations may be repeatedly performed.

In order to determine the position changing time for changing the relative positions of the first cartridge and the second cartridge, the result of comparing the consumption amount at which the first material of the first cartridge is consumed with respect to the usage chamber to currently pass the aerosol among chambers of the second cartridge, with a reference consumption amount may be used.

In the method of generating an aerosol according to the embodiment of FIG. 13, by changing the relative positions of the first cartridge and the second cartridge (operation S190), the usage chamber to currently pass the aerosol among the chambers of the second cartridge may be replaced so that the position of a subsequent chamber may be immediately changed to a position corresponding to a delivery hole of the first cartridge.

FIG. 14 is a flowchart schematically illustrating another method of generating an aerosol regarding the aerosol generating device according to the embodiments of FIGS. 1 through 12, according to another embodiment.

Operations S100-S180 of the method of generating an aerosol according to the embodiment of FIG. 14 are similar to operations S100-S180 of the method of generating an aerosol according to the embodiment of FIG. 13, but, after detecting of the remaining amount of the first material accommodated in the first cartridge to determine a consumption amount at which the first material is consumed with respect to a usage chamber to currently pass the aerosol and comparing of the consumption amount of the first material with a reference consumption amount to determine a position changing time at which changing of the position of the second cartridge with respect to the first cartridge is required (operation S180) is performed, outputting a replacement notification notifying that changing of positions of the chambers is required (operation S181), receiving an input signal generated by the user's input manipulation for changing the relative position of the second cartridge with respect to the first cartridge (operation S182), when the input signal is received, checking whether the current usage chamber is the last chamber among chambers of the second cartridge (operation S200), and when the current usage chamber is not the last chamber, changing the relative positions of the first cartridge and the second cartridge (operation S190) may be sequentially performed.

The changing of the relative positions of the first cartridge and the second cartridge (operation S190) may be automatically performed by a driving device that operates by the controller, or may be performed by the user's manual operation.

When the relative positions of the first cartridge and the second cartridge are changed, the usage chamber may be immediately removed from the position corresponding to the delivery hole, and a subsequent chamber may be aligned in the delivery hole and then, the aerosol may pass through the subsequent chamber, or the usage chamber and the subsequent chamber may perform an operation of passing the aerosol temporarily together, and as time passes, only the subsequent chamber may perform an option of passing the aerosol.

After the changing of the relative positions of the first cartridge and the second cartridge (operation S190) is performed, the method may return to the detecting of the user's inhalation operation (operation S100) and thus, the above-described operations may be repeatedly performed.

In the method of generating an aerosol and the aerosol generating device according to the above-described embodiments, even when the first cartridge is designed to accommodate a large amount of first material, chambers in use to supply the aerosol may be selected by automatically rotating the second cartridge by using the driving device, so that the effect of replacing a new second material may be obtained without replacing the second cartridge including the second material.

In addition, because the chambers of the second cartridge include different types of second materials, the user may select a desired second material by selecting one from among the chambers so that the user may freely enjoy the aerosol having various flavors.

In addition, because the result of comparing the consumption amount of the first material of the first cartridge consumed corresponding to each of the chambers and the reference consumption amount is used as a criterion for determining the usage time, i.e., a lifetime of each of the chambers of the second cartridge, even when the second cartridge includes a plurality of chambers, the user may comfortably enjoy inhaling the aerosol without experiencing discomfort.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

INDUSTRIAL APPLICABILITY

One or more embodiments relate to an aerosol generating device, whereby the position of a second cartridge may be adjusted based on the remaining amount of a first cartridge and thus it is convenient to carry and use the aerosol generating device.

The invention claimed is:

1. An aerosol generating device comprising:

a first cartridge configured to accommodate a first material therein and comprising a delivery hole through which an aerosol generated from the first material is delivered;

a second cartridge comprising a plurality of chambers for accommodating a second material including a granule in a solid state such that the aerosol delivered from the first cartridge passes through the second material and is discharged to an outside of the aerosol generating device, a position of the second cartridge with respect to the first cartridge being changeable so that at least one of the plurality of chambers corresponds to the delivery hole;

an upper plate covering upper ends of the plurality of chambers and including an upper through hole through which the aerosol, which passed through the second material, is discharged out of the plurality of chambers, a remaining amount sensor configured to detect a remaining amount of the first material accommodated in the first cartridge so as to generate a sensing signal; and a controller configured to determine, based on the sensing signal, a consumption amount at which the first material is consumed with respect to a usage chamber that currently passes the aerosol among the plurality of chambers, compare the consumption amount of the first material with a pre-set reference consumption amount of the first material with respect to the usage chamber, and determine a position changing time at which changing of a position of the second cartridge with respect to the first cartridge is required, wherein each of the plurality of chambers comprises a lower through hole which is positioned under the chambers, and wherein the aerosol delivered from the delivery hole passes through the lower through hole and is delivered toward the second material.

2. The aerosol generating device of claim 1, further comprising a driving device configured to change the position of the second cartridge with respect to the first cartridge by moving at least one of the first cartridge and the second cartridge, wherein the controller is further configured to change the position of the second cartridge with respect to the first cartridge by operating the driving device at the position changing time.

3. The aerosol generating device of claim 1, further comprising an information generator configured to transmit information to the outside of the aerosol generating device, wherein the controller is further configured to output a replacement notification for changing positions of the plurality of chambers to the information generator at the position changing time.

4. The aerosol generating device of claim 3, further comprising:

an input device configured to receive a user's input manipulation to generate an input signal; and a driving device configured to change the position of the second cartridge with respect to the first cartridge by moving at least one of the first cartridge and the second cartridge, wherein the controller is further configured to change the position of the second cartridge with respect to the first cartridge by operating the driving device based on the input signal of the input device.

5. The aerosol generating device of claim 3, further comprising:

a handle that is manipulable by a user to change the position of the second cartridge relative to the first cartridge; and a force transmission portion configured to transmit force of the user from the handle to the first cartridge or the second cartridge to change the position of the second cartridge with respect to the first cartridge.

6. The aerosol generating device of claim 2, wherein any one of the first cartridge and the second cartridge is rotatably coupled to another one of the first cartridge and the second cartridge, and the driving device is further configured to rotate any one of the first cartridge and the second cartridge.

7. The aerosol generating device of claim 2, wherein any one of the first cartridge and the second cartridge is coupled to the other one of the first cartridge and the second cartridge to be movable linearly, and the driving device linearly moves any one of the first cartridge and the second cartridge.

8. The aerosol generating device of claim 2, wherein the controller is further configured to change the position of the second cartridge with respect to the first cartridge so that a position of any one of the plurality of chambers is aligned with the delivery hole.

9. The aerosol generating device of claim 2, wherein the controller is further configured to change the position of the second cartridge with respect to the first cartridge so that adjacent chambers among the plurality of chambers simultaneously overlap the delivery hole.

10. The aerosol generating device of claim 1, wherein the remaining amount sensor comprises any one or any combination of a capacitive sensor, an ultrasonic wave sensor, and an optical sensor.

11. The aerosol generating device of claim 1, wherein the first cartridge comprises a plurality of storages for accommodating the first material therein, each of the plurality of storages comprises the delivery hole, and the position of the second cartridge with respect to the first cartridge is changed so that a position of at least one of the plurality of chambers corresponds to the delivery hole of any one of the plurality of storages.

12. The aerosol generating device of claim 1, wherein in a state in which an amount of the second material accommodated in each of the plurality of chambers is equal, the pre-set reference consumption amount of the first material corresponding to each of the plurality of chambers is set to be equal with respect to all of the plurality of chambers.

13. The aerosol generating device of claim 1, wherein in a state in which an amount of the second material accommodated in each of the plurality of chambers is different or a material of the second material is different for each of the second material accommodated in each of the plurality if chambers is different, the pre-set reference consumption amount of the first material corresponding to each of the plurality of chambers is set to be different with respect to all of the plurality of chambers.

* * * * *